US007025114B2

(12) United States Patent
Nagasaka et al.

(10) Patent No.: US 7,025,114 B2
(45) Date of Patent: Apr. 11, 2006

(54) CASTING METHOD AND CASTING MOLD

(75) Inventors: Takeshi Nagasaka, Kariya (JP); Tomoyuki Hatano, Nagoya (JP); Hiromi Takagi, Nagoya (JP); Ikuo Ozawa, Toyoake (JP); Yasushi Hibi, Kariya (JP); Minoru Furuhata, Osaka (JP); Koji Tsuboe, Osaka (JP); Isao Uenaka, Osaka (JP)

(73) Assignee: DENSO Corporation, Kariya (JP)

( * ) Notice: Subject to any disclaimer, the term of this patent is extended or adjusted under 35 U.S.C. 154(b) by 53 days.

(21) Appl. No.: 10/683,477

(22) Filed: Oct. 10, 2003

(65) Prior Publication Data

US 2005/0072550 A1 Apr. 7, 2005

Related U.S. Application Data

(63) Continuation-in-part of application No. 10/189,812, filed on Jul. 3, 2002, now abandoned.

(30) Foreign Application Priority Data

Jul. 4, 2001 (JP) ..... 2001-203913
Oct. 11, 2002 (JP) ..... 2002-299477

(51) Int. Cl.
*B22D 17/10* (2006.01)

(52) U.S. Cl. ..... 164/113; 164/312; 164/121; 164/137

(58) Field of Classification Search ..... 164/113, 164/121, 137, 135, 339, 312, 296, 340
See application file for complete search history.

(56) References Cited

U.S. PATENT DOCUMENTS 3,137,904 A * 6/1964 Steinman et al. ..... 164/342
3,575,233 A * 4/1971 Mahle et al. ..... 164/312
5,323,840 A * 6/1994 Usui et al. ..... 164/332
6,460,596 B1 * 10/2002 Yamaguchi et al. ..... 164/72

FOREIGN PATENT DOCUMENTS

JP 58-199131 11/1983
JP 3-136822 6/1991

* cited by examiner

*Primary Examiner*—Len Tran
(74) *Attorney, Agent, or Firm*—Harness, Dickey & Pierce, PLC

(57) ABSTRACT

A casting method and casting mold able produce a casting having an island and connecting portion is disclosed. A casting having a body, an opening provided so as to pass through the body, an island arranged separated from the body in the opening, and a connecting portion joining the island and body is cast using a casting mold. The casting mold is provided with a body gate connected to a body cavity for forming the body and an opening gate connected to an island/connecting portion cavity for forming the island and the connecting portion. The body gate and opening gate are connected to a runner through body pin gates and opening pin gates; in addition, a die casting mold able to suitably change between a three-part mold structure and a two-part mold structure to cast a die casting is disclosed. The three-part mold structure die casting mold, a movable mold, a first cavity, a connection sleeve, a first runner, a pin gate, and an extension sleeve. When forming the two-part mold structure die casting mold, the fixed mold is removed, the extension sleeve insert inserted in the extension sleeve is removed, and the pin gate is filled by a pin gate insert. Further, the intermediate mold insert and the movable mold insert are replaced to form the two-part mold structure die casting mold forming the second cavity and second runner moving the movable mold with respect to the intermediate mold.

43 Claims, 22 Drawing Sheets

CASTING METHOD AND CASTING MOLD

BACKGROUND OF THE INVENTION

1. Field of the Invention

The present invention relates to a casting method and a casting mold for casting a product having a body, an opening provided so as to pass through that body, an island arranged inside the hollow away from the body, and a connecting portion connecting the island and the body, in particular a case of casting a product with thicknesses of the body, island, and connecting portion of 1.5 to 4 mm. Note that here, the term "mold" is used in a sense including both "molds" and "dies".

Further, the present invention relates to a die casting mold of a three-part mold structure using three molds to form a thin die casting or a complicatedly shaped die casting.

2. Description of the Related Art

In the past, for example in the die casting method for casting a product used for various parts, a cavity having the same shape as the product has been formed between a pair of molds and a melt of metal has been filled in the cavity to cast the product.

In this die casting method, a gate serving as an inlet for the melt in the cavity and a runner for guiding the melt poured from a pouring portion into the gate are provided between the pair of molds. Further, the melt is poured into a sleeve at the pouring portion and the melt injected to the runner by a plunger to fill the melt in the cavity from the runner through the gate.

With this conventional casting method, it was difficult to produce a casting having a complicated shape or a thin casting. For example, it was difficult to cast a part having an opening provided so as to pass through the body and having inside that opening an island arranged separated from the body and a connection portion joining the island and body.

That is, in a casting having such an island and connecting portion, the melt flowing from the runner to the body has to flow to the island through the connecting portion. It is however not easy to feed melt from the body to the connecting portion and island. In many cases, the melt is not sufficiently filled there—resulting in casting defects.

The problem of casting defects can be said to occur not only in the die casting method, but also general casting methods. Therefore, a casting method able to produce a casting having an island and connecting portion easily and with a high quality has been desired.

In another respect, almost all die casting molds for forming the die castings are of two-part mold structures having a fixed mold having a connection sleeve for injection of the melt and a movable mold able to move relative to the fixed mold and forming a die casting in a cavity formed between the fixed mold and movable mold. As opposed to this, the inventors discovered a three-part mold structure die casting mold provided with an intermediate mold between the fixed mold and movable mold.

In this three-part mold structure die casting mold, the melt injected from the connection sleeve is filled into a cavity formed between the intermediate mold and movable mold through a runner formed between the fixed mold and movable mold and a pin gate formed at the intermediate mold. Afterwards, the intermediate mold is moved with respect to the fixed mold, then the movable mold is moved with respect to the intermediate mold and the die casting formed in the cavity is taken out.

Note that as prior art documents related to the invention of this application, there are Japanese Unexamined Patent Publication (Kokai) No. 58-199131 and Japanese Unexamined Patent Publication (Kokai) No. 3-136822.

This three-part mold structure die casting mold can form a thin die casting with a thickness of for example 1.5 to 4 mm or a die casting with a complicated shape while prevent casting defects. Therefore it is not suitable for forming a thick die casting with a thickness of for example over 4 mm or a die casing with not that complicated a shape. Further, in this case, use of a conventional two-part mold structure die casting mold facilitates handling and facilitates maintenance etc. since it is simple in structure.

That is, the above two-part mold structure die casting mold and three-part mold structure die casting mold each has its advantages and disadvantages. Therefore, a die casting mold having the advantages of both has been desired.

SUMMARY OF THE INVENTION

An object of the present invention is to provide a casting method and casting mold able to easily produce a casting having an island and connecting portion in a high quality state.

Another object of the present invention is to provide a die casting mold able to be suitably changed between a three-part mold structure and two-part mold structure in accordance with the shape of the individual die casting and therefore able to optimally form a die casting.

According to a first aspect of the present invention, there is provided a casting method for casting a product having a body, an opening provided so as to pass through the body, an island provided separated from the body in the opening, and a connecting portion joining the island and body using a mold having a cavity corresponding to the shape of the product, the mold being provided with a body gate connected to a body cavity for forming the body in the cavity and an opening gate connected to an island/connecting portion cavity for forming the island and connecting portion in the opening in the cavity; the body gate and opening gate being connected to a runner for introducing a melt into them; and the melt fed into the runner being filled in the cavity through the body gate and the opening gate.

That is, the present invention provides a casting method for a product having a body forming the outer shape of the product as a whole and an island and connecting portion formed in the opening passing through the body.

Further, in the present invention, use is made of a mold providing the body gate and opening gate at a body cavity and island/connecting portion cavity and connecting these gates to a runner.

Therefore, it is possible to easily produce a casting having a complicated shape in a state with no casting defects.

That is, the melt introduced into the runner is divided between the body gate and the opening gate. Further, the melt starts to be filled in the body cavity from the body gate, while the melt starts to be filled in the island/connecting portion cavity from the opening gate. That is, melt is directly sent through the gates to the body cavity and the island/connecting portion cavity.

Accordingly, it is possible to prevent melt from being supplied later to one cavity than the other cavity and possible to directly and quickly fill melt to both cavities. For this reason, it is possible to prevent the delay of supply of melt and the occurrence of casting defects.

In this way, it is possible to match as much as possible the ease of filling of melt between the body cavity and the island/connecting portion cavity even when producing a casting having an island and connecting portion.

Accordingly, it is possible to easily produce a high quality casting with almost no problem of casting defects even in a casting having an island and connecting portion.

According to a second aspect of the present invention, there is provided a casting mold for casting a product having a body, an opening provided so as to pass through the body, an island provided separated from the body in the opening, and a connecting portion joining the island and body, the mold having a three-part structure of a fixed mold, intermediate mold, and movable mold; the intermediate mold and movable mold being provided between them with a cavity having a body cavity for forming the body and an island/connecting portion cavity for forming the island and the connecting portion in the opening, a body gate connected to the body cavity, and an opening cavity connected to the island/connecting portion cavity; the fixed mold and the intermediate mold being provided between them with a runner for introducing melt into the body gate and the opening gate; the intermediate mold being provided with a body pin gate connecting the runner and the body gate and an opening pin gate connecting the runner and the opening gate; and the melt sent into the runner being filled in the cavity through the body pin gate and body gate and through the opening pin gate and opening gate.

The structure of the casting mold of the present invention does not form the cavity, gates, and runner at the interface of a pair of molds as in the past, but forms them at other portions than the interface for a three-dimensional arrangement.

Due to this, it is possible to form the opening gate directly in the island/connecting portion cavity where the melt has difficulty flowing to and introduce the melt from the opening gate directly to the island/connecting portion cavity. Further, to introduce melt directly to the body cavity and island/connecting portion cavity, it is also possible to provide the above body pin gate and opening pin gate, respectively.

This structure of the mold can be realized by a three-part structure of a fixed mold, intermediate mold, and movable mold as explained above.

That is, the runner is provided between the fixed mold and the intermediate mold, and the cavity, body gate, and opening gate are provided between the intermediate mold and movable mold. Further, the intermediate mold is provided with the body pin gate for connecting the body cavity and body gate and the opening pin gate for connecting the island/connecting portion cavity and the opening gate.

Due to this, it is possible to supply melt directly to the body cavity and the island/connecting portion cavity and possible to easily release the product etc. from the mold after the casting as explained above.

For this reason, if using the casting mold of the present invention, it is possible to realize a casting method which enables the formation of a casting in a high quality state free from casting defects even for a casting having the island and connecting portion and which enables the casting to be easily taken out from the casting mold after being shaped.

According to a third aspect of the present invention, there is provided a casting method for casting a product having a body, an opening provided so as to pass through the body, an island provided separated from the body in the opening, and a connecting portion joining the island and body using a mold having a cavity corresponding to the shape of the product, the mold having a body cavity for forming the body in the cavity, an island/connecting portion cavity for forming the island and the connecting portion in the opening in the cavity, and an opening gate connected to the island/connecting portion cavity, the opening gate being connected to a runner introducing melt into it; the melt fed into the runner being filled in the cavity through the opening gate.

The melt fed into the runner starts to be filled in the island/connecting portion cavity from the opening gate. Further, the melt flowing into the island/connecting portion cavity then flows into the body cavity and fills the cavity as a whole.

In this way, since the melt is introduced into the cavity through the opening gate, it is possible to prevent the problems of casting defects etc. in the island/connecting portion cavity and possible to produce a high quality casting.

According to a fourth aspect of the present invention, there is provided a casting mold for casting a product having a body, an opening provided so as to pass through the body, an island provided separated from the body in the opening, and a connecting portion joining the island and body, the mold having a three-part structure of a fixed mold, intermediate mold, and movable mold; the intermediate mold and movable mold being provided between them with a cavity having a body cavity for forming the body and an island/connecting portion cavity for forming the island and the connecting portion in the opening and an opening cavity connected to the island/connecting portion cavity; the fixed mold and the intermediate mold being provided between them with a runner for introducing melt into the opening gate; the intermediate mold being provided with an opening pin gate connecting the runner and the opening gate; and the melt sent into the runner being filled in the cavity through the opening pin gate and opening gate.

By using this casting mold, it is possible to easily introduce a melt into the cavity through the opening gate. Due to this, if using this casting mold, it is possible to easily produce a high quality casting free of defects in the opening.

According to a fifth aspect of the invention, there is provided a three-part mold structure die casting mold having a fixed mold having connection sleeve connected to an ejection sleeve for injecting a melt, an intermediate mold able to move with respect to the fixed mold, and a movable mold able to move with respect to the intermediate mold, the intermediate mold and the movable mold having between them a cavity for injection of the melt to form a die casting, the fixed mold and the intermediate mold having between them a first runner connected to the connection sleeve, and the intermediate mold having inside it a pin gate connecting the first runner and the cavity, wherein the intermediate mold is formed with an extension sleeve provided on an extension of the connection sleeve, the intermediate mold and the movable mold have formed between them a second runner for connecting the extension sleeve and the cavity, the extension sleeve has an extension sleeve insert inserted in it for filling the same, and the second runner has a second runner insert inserted in it for filling the same; the cavity is formed between an intermediate mold insert inserted detachably in the intermediate mold and a movable mold insert inserted detachably in the movable mold; and the die casting mold is designed to be able to form a two-part mold structure die casting mold moving the movable mold with respect to the intermediate mold by removing the fixed mold, removing the extension sleeve insert and the second runner insert inserted in the extension sleeve and the second runner, or filling the pin gate by a pin gate insert inserted into the intermediate mold and replacing at least one of the intermediate mold insert and the movable mold insert with another intermediate mold insert or another movable mold insert to form another cavity.

The die casting mold of the present invention is designed to be able to be changed between the three-part mold structure and the two-part mold structure in accordance with the shape of the die casting to be formed. Further, to realize this, a insert enabling a change of the cavity is formed when forming a three-part mold structure and a insert structure is formed at a predetermined position used when forming a two-part mold structure.

That is, the three-part mold structure die casting mold is comprised of the fixed mold, intermediate mold, and movable mold and has an extension sleeve insert and second runner insert inserted in the extension sleeve provided at the intermediate mold and the second runner provided between the intermediate mold and movable mold. Further, the cavity is formed between the intermediate mold insert and the movable mold insert. In the three-part mold structure die casting mold, a path for the melt communicating the connection sleeve with the cavity through the first runner is formed.

Further, the die casting mold is designed to allow for the formation of the above two-part mold structure by removing the fixed mold, removing the extension sleeve insert and second runner insert, and filling the pin gate with the pin gate insert. Further, at least one of the intermediate mold insert and movable mold insert is replaced with another intermediate mold insert or another movable mold insert to form another cavity. To form the above two-part mold structure die casting mold, it is also possible to form a path for the melt communicating the extension sleeve with the second cavity through the second runner.

In this way, it is possible to use the fixed mold and intermediate mold used when forming the above three-part mold structure to form a two-part mold structure for forming a die casting different from the die casting formed when forming a three-part mold structure. Therefore, it is possible to use the same die casting mold to form die castings of different shapes.

When forming a thin die casting with a thickness of for example 1.5 to 4 mm or a die casting with a complicated shape, in general casting is difficult. Therefore, at this time, it is possible to form the above three-part mold structure die casting mold and fill the melt directly into the parts of the difficult to cast casting through the pin gate. At this time, it is possible to prevent casting defects and form a high quality die casting.

On the other hand, when forming a thick die casting with a thickness of for example over 4 mm or a die casting with not that complicated a shape, in general casting is not that difficult. Therefore, at this time, it is possible to form the above simple structure two-part mold structure die casting mold to facilitate the handling and improve the maintenance ability etc.

In this way, the die casting mold of the present invention can combine the superior features of the above three-part mold structure and the superior features of the above two-part mold structure. That is, according to the die casting mold of the present invention, it is possible to suitably switch between the three-part mold structure and the two-part mold structure in accordance with the shape of the individual die casting and form the best die casting mold for the individual die casting.

According to a sixth aspect of the invention, there is provided a three-part mold structure die casting mold having a fixed mold having a connection sleeve connected to an ejection sleeve for injecting a melt, an intermediate mold able to move with respect to the fixed mold, and a movable mold able to move with respect to the intermediate mold, the intermediate mold and the movable mold having between them a cavity for injection of the melt to form a die casting, the fixed mold and the intermediate mold having between them a first runner connected to the connection sleeve, and the intermediate mold having inside it a pin gate connecting the first runner and the cavity, wherein the intermediate mold is formed with an extension sleeve provided on an extension of the connection sleeve, the intermediate mold and the movable mold have formed between them a second runner for connecting the extension sleeve and the cavity, the extension sleeve has an extension sleeve insert inserted in it for filling the same, and the second runner has a second runner insert inserted in it for filling the same; the intermediate mold is formed with an extension sleeve provided on an extension of the connection sleeve, and the extension sleeve has an extension sleeve insert inserted in it for filling it; the cavity is formed between an intermediate mold insert inserted detachably in the intermediate mold and a movable mold insert inserted detachably in the movable mold; and the die casting mold is designed to be able to form a two-part mold structure die casting mold moving the movable mold with respect to the intermediate mold by removing the fixed mold, removing the extension sleeve insert inserted in the extension sleeve, filling the pin gate by a pin gate insert to be inserted into the intermediate mold, and replacing at least one of the intermediate mold insert and the movable mold insert with another intermediate mold insert or another movable mold insert to form another cavity and a second runner connecting this and the above extension sleeve.

In the present invention, the second runner is formed at least at one of the other intermediate mold insert and other movable mold insert when forming the above two-part mold structure die casting mold. That is, in the present invention, since no second runner is formed directly between the intermediate mold and the movable mold as in the three-part mold structure die casting mold, it is not necessary to provide a second runner insert such as shown in the fifth aspect of the invention and the insert structure is simple. In addition, in the present invention as well, it is possible to obtain similar actions and effects as in the fifth aspect of the invention.

According to a seventh aspect of the invention, there is provided a three-part mold structure die casting mold having a fixed mold having a connection sleeve connected to an ejection sleeve for injecting a melt, an intermediate mold able to move with respect to the fixed mold, and a movable mold able to move with respect to the intermediate mold, the intermediate mold and the movable mold having between them a cavity for injection of the melt to form a die casting, the fixed mold and the intermediate mold having between them a first runner connected to the connection sleeve, and the intermediate mold having inside it a pin gate connecting the first runner and the cavity, wherein the intermediate mold is formed with an extension sleeve provided on an extension of the connection sleeve, the intermediate mold and the movable mold have formed between them a second runner for connecting the extension sleeve and the cavity, the extension sleeve has an extension sleeve insert inserted in it for filling it, and the second runner has a second runner insert inserted in it for filling it; the cavity is formed between an intermediate mold insert inserted detachably in the intermediate mold and a movable mold insert inserted detachably in the movable mold; and the die casting mold is designed to be able to form a two-part mold structure die casting mold moving the movable mold with respect to both the fixed mold and the intermediate mold in a state with the two closed by removing the extension sleeve insert and the second runner insert inserted in the extension sleeve and the second runner, filling the first runner by a fixed mold insert to be inserted in the fixed mold, filling the pin gate by a pin gate insert to be inserted into the intermediate mold, and replacing at least one of the intermediate mold insert and the movable mold insert with another intermediate mold insert or another movable mold insert to form another cavity.

The die casting mold of the present invention can also be switched between the above three-part mold structure and the above two-part mold structure in accordance with the shape of the die casting formed.

Further, in the present invention, the above two-part mold structure is formed using the above fixed mold, intermediate mold, and movable mold. Further, the fixed mold and intermediate mold are fixed and the movable mold moved with respect to them.

In the present invention, when forming the above two-part mold structure die casting mold, since the fixed mold, intermediate mold, and movable mold are used in the same way as the above three-part mold structure die casting mold, it is easy to change from the three-part mold structure to the two-part mold structure.

With the die casting mold of the present invention as well, it is possible to suitably change between the three-part mold structure and two-part mold structure in the same way as the above and possible to form the best die casting mold for each die casting.

According to an eighth aspect of the invention, there is provided a three-part mold structure die casting mold having a fixed mold having a connection sleeve connected to an ejection sleeve for injecting a melt, an intermediate mold able to move with respect to the fixed mold, and a movable mold able to move with respect to the intermediate mold, the intermediate mold and the movable mold having between them a cavity for injection of the melt to form a die casting, the fixed mold and the intermediate mold having between them a first runner connected to the connection sleeve, and the intermediate mold having inside it a pin gate connecting the first runner and the cavity, wherein the intermediate mold is formed with an extension sleeve provided on an extension of the connection sleeve, and the extension sleeve has an extension sleeve insert inserted in it for filling it; the cavity is formed between an intermediate mold insert inserted detachably in the intermediate mold and a movable mold insert inserted detachably in the movable mold; and the die casting mold is designed to be able to form a two-part mold structure die casting mold moving the movable mold with respect to both the fixed mold and the intermediate mold in a state with the two closed by removing the extension sleeve insert inserted in the extension sleeve, filling the first runner by a fixed mold insert to be inserted in the fixed mold, filling the pin gate by a pin gate insert to be inserted into the intermediate mold, and replacing at least one of the intermediate mold insert and the movable mold insert with another intermediate mold insert or another movable mold insert to form another cavity and a second runner connecting this and the above extension sleeve.

In the present invention, the second runner is formed from another intermediate mold insert and another movable mold insert when forming the two-part mold structure die casting mold. That is, in the present invention, since no second runner is formed directly between the intermediate mold and the movable mold as in the three-part mold structure die casting mold, it is not necessary to provide a second runner insert such as shown in the seventh aspect of the invention and the insert structure is simple. In addition, in the present invention as well, it is possible to obtain similar actions and effects as in the seventh aspect of the invention.

According to a ninth aspect of the invention, there is provided a three-part mold structure die casting mold having a fixed mold having a connection sleeve connected to an ejection sleeve for injecting a melt, an intermediate mold able to move with respect to the fixed mold, and a movable mold able to move with respect to the intermediate mold, the intermediate mold and the movable mold having between them a cavity for injection of the melt to form a die casting, the fixed mold and the intermediate mold having between them a first runner connected to the connection sleeve, and the intermediate mold having inside it a pin gate connecting the first runner and the cavity, wherein the intermediate mold and the movable mold have formed between them a second runner for connecting the connection sleeve and the cavity, and the second runner has a second runner insert inserted in it to fill it; the cavity is formed between an intermediate mold insert inserted detachably in the intermediate mold and a movable mold insert inserted detachably in the movable mold, and the first runner is formed between a fixed mold insert inserted detachably with respect to the fixed mold and the intermediate mold; and the die casting mold is designed to be able to form a two-part mold structure die casting mold moving the movable mold with respect to the fixed mold by removing the intermediate mold, removing the second runner insert inserted in the second runner, and replacing the fixed mold insert with another fixed mold insert or replacing the fixed mold insert and the movable mold insert with other fixed mold insert and movable mold insert.

The die casting mold of the present invention can also be switched between the above three-part mold structure and the above two-part mold structure in accordance with the shape of the die casting formed.

Further, in the present invention, the above two-part mold structure is formed using the above fixed mold, intermediate mold, and movable mold. Further, in the present invention, the first runner is formed using the fixed mold insert. When forming the two-part mold structure, the fixed mold insert is switched with another fixed mold insert.

Further, in the three-part mold structure die casting mold of the present invention, the intermediate mold is not formed with the above extension sleeve and the extension sleeve insert is not required. Therefore, according to the present invention, it is possible to form the above two-part mold structure die casting mold extremely easily.

With the die casting mold of the present invention as well, like with the fifth aspect of the invention, it is possible to suitably change between the three-part mold structure and two-part mold structure in the same way and possible to form the best die casting mold for each die casting.

According to a 10th aspect of the invention, there is provided a three-part mold structure die casting mold having a fixed mold having a connection sleeve connected to an ejection sleeve for injecting a melt, an intermediate mold able to move with respect to the fixed mold, and a movable mold able to move with respect to the intermediate mold, the intermediate mold and the movable mold having between them a cavity for injection of the melt to form a die casting, the fixed mold and the intermediate mold having between them a first runner connected to the connection sleeve, and the intermediate mold having inside it a pin gate connecting the first runner and the cavity, wherein the cavity is formed between an intermediate mold insert inserted detachably in the intermediate mold and a movable mold insert inserted detachably in the movable mold, and the first runner is formed between a fixed mold insert inserted detachably in the fixed mold and the intermediate mold; and the die casting mold is designed to be able to form a two-part mold structure die casting mold moving the movable mold with respect to the fixed mold by removing the intermediate mold and replacing the fixed mold insert with another fixed mold insert or replacing the fixed mold insert and the movable mold insert with another fixed mold insert and another movable mold insert to fill the first runner and form another cavity and a second runner connecting this and the extension sleeve.

In the present invention, the second runner is formed by another intermediate mold insert and another movable mold insert when forming the two-part mold structure die casting mold. That is, in the present invention, since no second runner is formed directly between the intermediate mold and the movable mold as in the three-part mold structure die casting mold, it is not necessary to provide a second runner insert such as shown in the eighth aspect of the invention and the insert structure is simple. In addition, in the present invention as well, it is possible to obtain similar actions and effects as in the eighth aspect of the invention.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Figure 1:
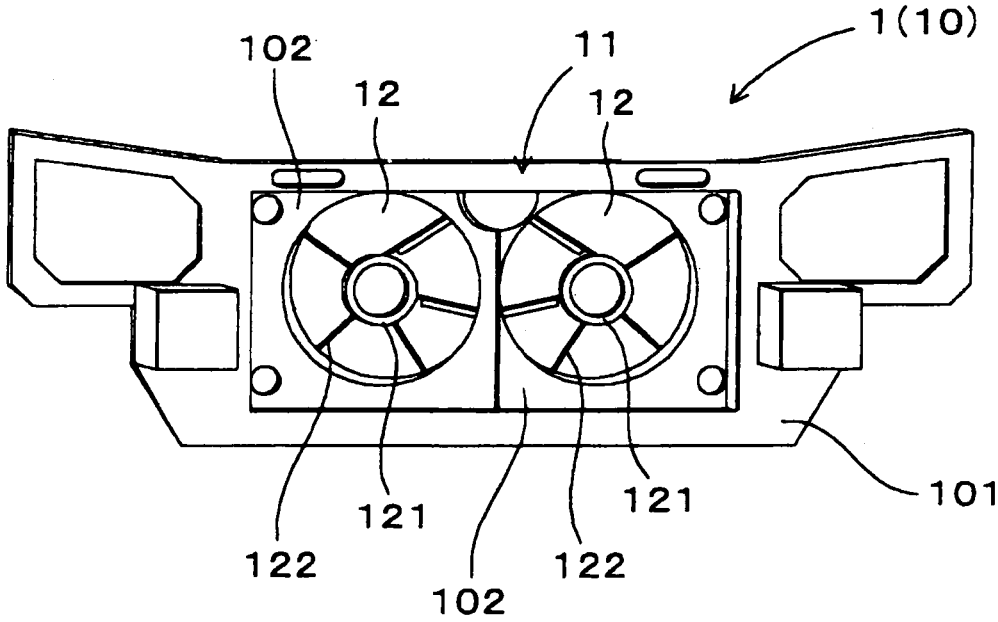
FIG. 1 is a perspective view of the overall configuration of a casting in a first embodiment.

Below, a preferred embodiment of the present invention will be described with reference to the drawings.

In this case, the runner, pin gates, gates, and cavity may be arranged three-dimensionally. Therefore, it is possible to easily secure a path of supply of the melt from the runner to the body gate and opening gate.

Further, after filling the melt into the cavity and forming the casting, it is possible to move the fixed mold, intermediate mold, and movable mold relative to each other so as to release the castings formed in the cavity, pin gates, and runner from the fixed mold, intermediate mold, and movable mold and enable them to be easily removed.

Further, the method may comprise filling the melt, then moving the intermediate mold and movable mold to release the fixed mold and the intermediate mold; moving the movable mold to release the intermediate mold and movable mold, cutting the runner casting formed in the runner from pin gate castings formed in the body pin gate and the opening pin gate, and releasing the pin gate castings from the intermediate mold; then releasing the casting in the state from the mold with the pin gate castings attached from the movable mold.

In this case, after forming the casting, it is possible to successively move the fixed mold, intermediate mold, and movable mold to enable the formed casting to be easily released from the mold and taken out.

The intermediate mold and the movable mold may have between them a balance runner provided at least at part of the section between the body pin gate and the body gate and at least at part of the section between the opening pin gate and the opening gate. At least part of the melt may be supplied from the body pin gate through the balance runner to the body gate and from the opening pin gate through the balance runner to the opening gate.

By providing this balance runner, it is possible to adjust the rates of filling the melt between adjoining body gates or between adjoining opening gates and send the melt under pressure as equally as possible to all parts of the body cavity or island/connecting portion cavity.

The casting may for example be a front end panel for an automobile and have a body having a surround, an opening formed inside the surround, a part mount as an island arranged in the opening, and stays supporting the part mount as the connecting portion.

In this case, it is possible to cast the island and connecting portion of the front end panel without casting defects. Further, the front end panel can be formed integrally with the body, part mount, and stays by a single casting operation. Therefore, the casting cost can be reduced.

Here, the part mount may mount a motor, fan, or pulley. In this case, it is possible to produce a high quality front end panel using this part mount as the mount for a motor, fan, or pulley.

A plurality of at least one of the body gate and the opening gate may be provided. In this case, in the body cavity or island/connecting portion cavity, it is possible to reduce as much as possible the imbalance in distance from the body gates or opening gates to the portions for filling of the melt. Therefore, it is possible to fill the melt with a good balance in the cavities.

Here, the body pin gate and/or the opening pin gate may be reversely tapered to expand in channel area from the fixed mold toward the movable mold or from the movable mold toward the fixed mold. In this case, it is possible to easily cut the pin gate castings formed in the body pin gate and opening pin gate at the constricted part of the smallest channel area in the body pin gate or opening pin gate.

When forming the pin gates reversely tapered so as to expand in channel area from the fixed mold toward the movable mold, after forming the casting in the cavity, when moving the intermediate mold and movable mold with respect to the fixed mold, the pin gate castings stick to the pin gates and therefore can be easily cut.

When making the movable mold move from the intermediate mold, the pin gate castings can be easily released from the intermediate mold along the reversely tapered inclined surfaces.

On the other hand, when forming the pin gates reversely tapered to expand in channel area from the movable mold toward the fixed mold, after forming the casting in the cavity, when moving the movable mold with respect to the intermediate mold, the pin gate castings stick to the pin gates and therefore can be easily cut.

When making the intermediate mold move from the fixed mold, the pin gate castings can be easily released from the intermediate mold along the reversely tapered inclined surfaces.

The body pin gate and/or the opening pin gate may be provided at a cavity insert detachably inserted in a cavity insert setting hole provided in the intermediate mold. In this case, by preparing a plurality of types of cavity insert of different pin gate diameters and switching between them, it is possible to adjust the rates of flow of melt sent under pressure to the pin gates. By adjusting the inside diameter of the cavity insert, it is possible to easily change and adjust the inclination angle of the inclined surface of the reverse taper. Even if the pin gates become worn, maintenance becomes easy by exchanging only the cavity inserts. The cavity inserts can be produced divided into several parts.

The draft of at least part of an inner wall of the cavity at the movable mold side may be set to not more than 1°. In this case, when moving the movable mold from the intermediate mold, it is possible to move it while leaving the casting formed in the cavity at the inside wall of the cavity at the movable mold side by the frictional resistance between the casting and inside wall of the cavity at the movable mold side. If the draft of all portions in the cavity exceeds 1°, the frictional resistance between the casting and the inside wall of the cavity at the movable mold side is liable not to be sufficiently obtained.

The movable mold may be provided with a plurality of ejector pins for pushing out the casting formed in the cavity from the cavity. In this case, after forming the casting in the cavity, the casting can be pushed out and easily removed by moving the ejector pins in the direction of the intermediate mold.

The ejector pins may be provided to abut against the casting near body pin gates and/or opening pin gates. In this case, when releasing the casting from the casting mold, it is possible to stably and smoothly release the casting.

The intermediate mold and the movable mold may have between them a balance runner provided at least at part of the section between the body pin gates and the body gate and at least at part of the section between the opening pin gates and the opening gate. By providing this balance runner, it is possible to adjust the rates of filling of the melt between adjoining body gates or adjoining opening gates and send the melt under pressure as uniformly as possible to all parts of the body cavity or all parts of the island/connecting portion cavity.

When a balance runner is provided in the above way, the movable mold may be provided with a plurality of ejector pins for pushing out the casting formed in the cavity from the cavity and the ejector pins may be provided to abut against the balance runner near the positions of the body pin gates connected to the balance runner. In this case, when releasing the casting from the casting mold, it is possible to stably and smoothly release the casting.

A projection projecting out in the direction of the intermediate mold may be provided near a joining portion of a body pin gate and/or opening pin gate and the balance runner. In this case, after forming the casting in the cavity, when moving the movable mold with respect to the intermediate mold, it is possible to cause frictional resistance between the projection and the casting portion formed around it. Further, due to this frictional resistance, it is possible to easily move the movable mold in the state with the casting left in the movable mold.

An end part formed at the movable mold at the body pin gate and/or opening pin gate may be provided with a distributer projecting out toward an inlet of the body pin gate and/or the opening pin gate. In this case, when changing the direction of flow of the melt passing through the body pin gate or the opening pin gate, it is possible to cause the melt to easily strike the distributer and smoothly change the direction.

After forming the casting in the cavity, when moving the movable mold with respect to the intermediate mold, it is possible to cause frictional resistance between the distributer and the casting portion formed around it. Further, due to the frictional resistance, it is possible to easily move the movable mold in the state with the casting left in the movable mold.

After the melt finishes being filled, due to the formation of the distributer, the contact area between the distributer and the casting portion formed around it becomes larger. Therefore, it is possible to rapidly cool the casting portion formed around the distributer and possible to move the movable mold to rapidly remove the casting formed in the cavity.

The distributer may be shaped with a draft of at least part of not more than 1°. In this case, when moving the movable mold from the intermediate mold, it is possible to easily cause frictional resistance between the distributer and the casting portion formed around it to more easily move the movable mold in the state where the casting is left in the movable mold.

The portion where a body pin gate and/or opening pin gate connects with the runner may be provided with a constricted part reduced in channel area. In this case, when moving the movable mold with respect to the intermediate mold, it is possible to cause stress concentration at the constricted part and therefore easily cut the body pin gate or opening pin gate provided with the constricted part.

The runner may be branched into a body runner for introducing the melt into the body pin gate and an opening runner for introducing the melt into the opening pin gate. In this case, at the time of feeding the melt to the runner under pressure, it is possible to branch the flow path to the body cavity and the flow path to the island/connecting portion cavity, so it is possible to fill the melt in these cavities with a much better balance.

The body runner and opening runner may be adjusted in inside diameter so that the rates of filling the melt in them become substantially equal. In this case, it is possible to easily make the ease of filling the melt between the body cavity and the island/connecting portion cavity match and possible to produce a casting of a much higher quality.

The opening runner may have a shape similar to the shape of the island. That is, if the island is ring shaped, the opening runner may be provided in a circular curved shape matching with this. In this case, it is possible to easily provide the opening gate at the portion of the opening runner corresponding to the shape of the island and possible to fill the melt with a good balance in all parts of the island/connecting portion cavity.

The cavity may be connected to a pressure reducing means for reducing the pressure in the cavity. In this case, when filling the melt in the cavity, it is possible to positively reduce the pressure in the cavity and therefore possible to easily fill the melt at the different parts of the cavity.

The casting may be a front end panel for an automobile and have a body having a surround, an opening formed inside the surround, a part mount as an island arranged in the opening, and stays supporting the part mount as the connecting portion.

In this case, it is possible to cast the island and connecting portion of the front end panel without casting defects and thereby possible to produce a high quality front end panel. Further, the front end panel can be formed with the body, part mount, and stays by a single casting operation. Therefore, the casting cost can be reduced.

The part mount may mount a motor, fan, or pulley. In this case, it is possible to produce a high quality front end panel using the part mount to mount a motor, fan, pulley, or other part.

Preferred embodiments of the present invention will be described next. In the fifth to 10th aspects, the die casting mold can form an aluminum die casting. In this case, when forming the above three-part mold structure, for example it is possible to easily form a thin die casting having a thickness of 1.5 to 4 mm and possible to lighten the die casting. Further, the movable mold is preferably provided with a plurality of ejector pins for ejecting a die casting formed in the cavity from the cavity and a usage pin changing means for changing the ejector pins used among the plurality of ejector pins between when forming the three-part mold structure and when forming the two-part mold structure. In this case, it is possible to use ejector pins at predetermined positions according to the individual die castings formed when forming the three-part mold structure and the individual die castings formed when forming the two-part mold structure. Therefore, it is possible to arrange the ejector pins at positions not influencing much the shape of the die casting at the time of formation.

The above die casting mold preferably has a burner unit for adjusting a surface temperature in the cavity around the cavity. In this case, even when the surface temperature of the cavity is low before casting or at the start of casting (stage when number of castings is still small), it is possible to use the burner unit to heat the surface of the cavity and cast well.

Further, when providing the burner unit, preferably the cavity is formed around it with a plurality of insertion and positioning holes enabling insertion and positioning of the burner unit, and the burner unit can be changed in position among the insertion and positioning holes. In this case, the burner unit can be changed in position among the insertion and positioning holes in accordance with the shape of the cavity when forming the three-part mold structure or cavity when forming the two-part mold structure. Therefore, it is possible to adjust the surface temperature of the cavity much better.

The die casting mold preferably is provided with a pressurizing cylinder for pressurizing the casting to cut it from a casting formed in the pin gate when releasing a casting formed in the first runner from the intermediate mold in the case of forming the three-part mold structure. In this case, when forming the three-part mold structure, it is possible to reliably release the casting formed in the first runner appearing when moving the intermediate mold relative to the fixed mold from the casting formed in the pin gate.

Further, the die casting formed in the cavity is preferably a front end panel for attaching an auto part at the front of an automobile and for supporting an engine. In this case, it is possible to form a plurality of types of front end panels using the cavity using the three-part mold structure or the cavity using the two-part mold structure enjoying the advantages of both high quality and short time.

Further, when forming the three-part mold structure, it is possible to form a die casting having a body, an opening provided so as to pass through the body, an island arranged away from the body in the opening, and a connecting portion connecting the island and the body. In this case, it is possible to directly inject the melt through the pin gate into the portion of the cavity forming the island and the connecting portion where casting defects easily occur. Therefore, it is possible to cast with a high quality even a die casting having a complicated shape.

On the other hand, when forming a two-part mold structure, it is possible to form a die casting without an opening, island, or connecting portion. In this case, since the shape of the die casting is not that complicated, it is possible to form a die casting with almost no casting defects in a short time.

Figure 2:
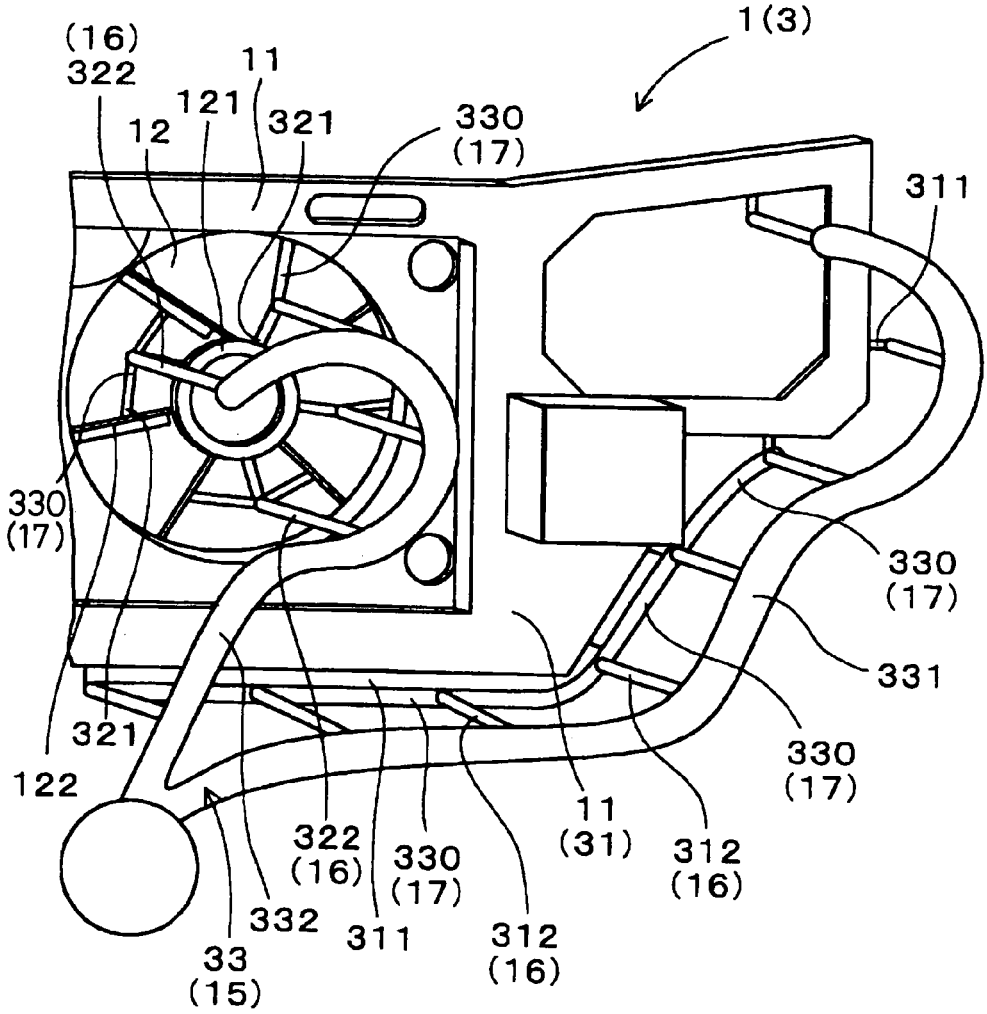
FIG. 2 is a partial perspective view of the state where part of the casting of the first embodiment and the casting portion formed at a runner at the time of casting are connected.

As shown in FIG. 1 and FIG. 2, in the casting method of this embodiment, a casting 1 having a body 11, openings 12 provided so as to pass through the body 11, islands 121 arranged separated from the body 11 in the openings 12, and connecting portions joining the islands 121 and the body 11 is produced. This casting 1 is produced, as explained later, using a casting mold 2 having a cavity 3 corresponding to the shape of the casting 1.

The casting method in this embodiment is a die casting method, and the casting 1 is a die casting.

First, the casting 1 to be produced in this embodiment will be explained in detail.

FIG. 1 is an explanatory view of the overall configuration of the casting 1, while FIG. 2 is an explanatory view of the state of parts of the casting 1 and casting portions formed in the melt path at the time of casting connected together. Reference numerals of the casting mold 2 are also shown.

As shown in FIG. 1 and FIG. 2, the casting 1 produced by this die casting method is a front end panel 10 that is a part of the frame of an automobile. The front end panel 10 is a frame part for attachment of a heat exchanger (radiator, condenser, etc.), headlights, etc. at the front of an automobile. The front end panel 10 is comprised of a body 11 and openings 12. The body 11 is comprised of a frame part 101 forming the overall shape and surrounds 102 formed around the openings 12. The surrounds 102 are formed by smooth curved surfaces and are designed so as to smoothly guide air blown from fans when attaching radiator fans in the openings 102.

The openings 12 are formed inside the surrounds 102. The islands 121 in the openings 12 of this embodiment form part mounts for mounting motors of the fans. The connecting portions 122 form stays for supporting the islands 121. The connecting portions 122 bridge the islands 121 and the surrounds 102 and support the islands 121 and fans fixed to the islands 121.

Note that the islands 121 may have other parts such as the above fans and pulleys mounted on them.

Next, the casting mold 2 will be explained.

Figure 3:
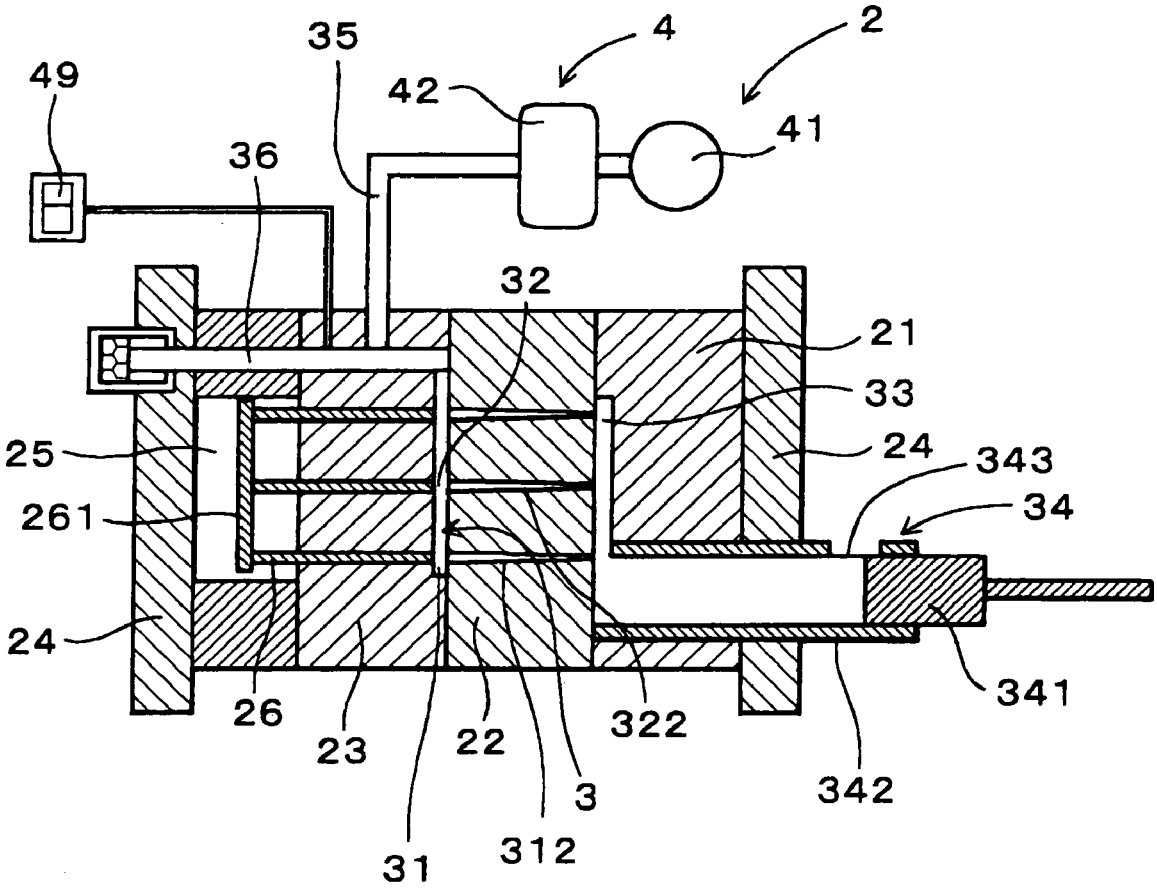
FIG. 3 is a sectional view of the structure of a casting mold in the first embodiment.

The casting mold 2 of the present embodiment, as shown in FIG. 3, has a three-part structure of a fixed mold 21, an intermediate mold 22, and a movable mold 23. Further, as shown in FIG. 2 and FIG. 3, the intermediate mold 22 and movable mold 23 are provided between them with a cavity 3 having a body cavity 31 for forming the body 11 and an island/connecting portion cavity 32 for forming the islands 121 and connecting portions 122 in the openings 12, body gates 311 connected to the body cavity 31, and opening gates 321 connected to the island/connecting portion cavity 32.

As shown in FIG. 3, the fixed mold 21 and intermediate mold 22 are provided between them with a runner 33 for introducing the melt into the body gates 311 and the opening gates 321.

The intermediate mold 22 is provided with body pin gates 312 connecting the runner 33 and the body gates 311 and opening pin gates 322 connecting the runner 33 and the opening gates 321. The melt fed into the runner 33 fills the cavity 3 through the body pin gates 312 and body gates 311 and through the opening pin gates 322 and opening gates 321.

As shown in FIG. 2, the intermediate mold 22 and the movable mold 23 have between them a balance runner 330 provided at least at part of the section between the body pin gates 312 and the body gates 311 and at least at part of the section between the opening pin gates 322 and opening gates 321.

In the present embodiment, as shown in FIG. 2, a plurality of the body gates 311 and opening gates 321 are provided. The body gate 311 connected to the portion at the middle of the body cavity 31 is formed long along the shape of the balance runner 330.

As shown in FIG. 3, the body pin gates 312 and the opening pin gates 322 are reversely tapered to expand in channel area from the fixed mold 21 toward the movable mold 23, that is, toward the cavity 3.

Figure 8:
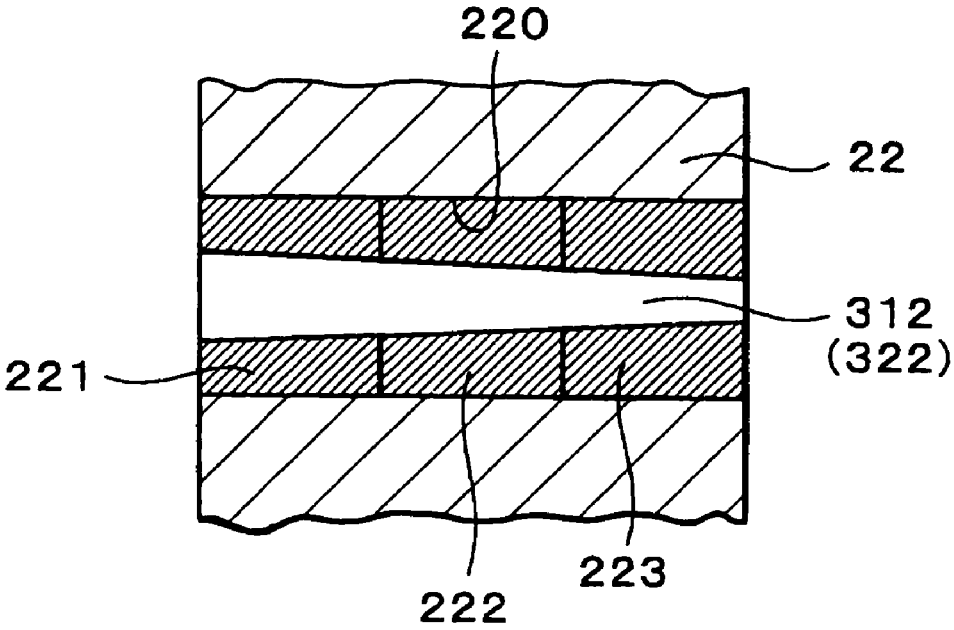
FIG. 8 is a partial sectional view of the structure of a body pin gate and opening pin gate in the first embodiment.

In the present embodiment, as shown in FIG. 8, a body pin gate 312 (or opening pin gate 322) is provided at cavity inserts 221 to 223 detachably inserted into a cavity insert setting hole 220 provided in the intermediate mold 22. Specifically, a cylinder able to be inserted into the circular-section through hole, that is, the cavity insert set hole 22, is comprised of the cavity inserts 221 to 223. In this embodiment, a cylinder divided into three parts is used. Further, the cavity inserts 221 to 223 are provided with tapered through holes. These three through holes are connected to form the tapered body pin gate 312 (or opening pin gate 322).

As shown in FIG. 3, the movable mold 23 is provided with a plurality of ejector pins 26 for pushing out the formed casting 1 in the cavity 3 from the cavity 3. The ejector pins 26 are connected by a pin frame 261 and are designed to simultaneously move to push out the casting 1. Further, the ejector pins 26 are provided to abut against the balance runner 330 near the positions of the body pin gates 312 connected to the balance runner 330.

Figure 9:
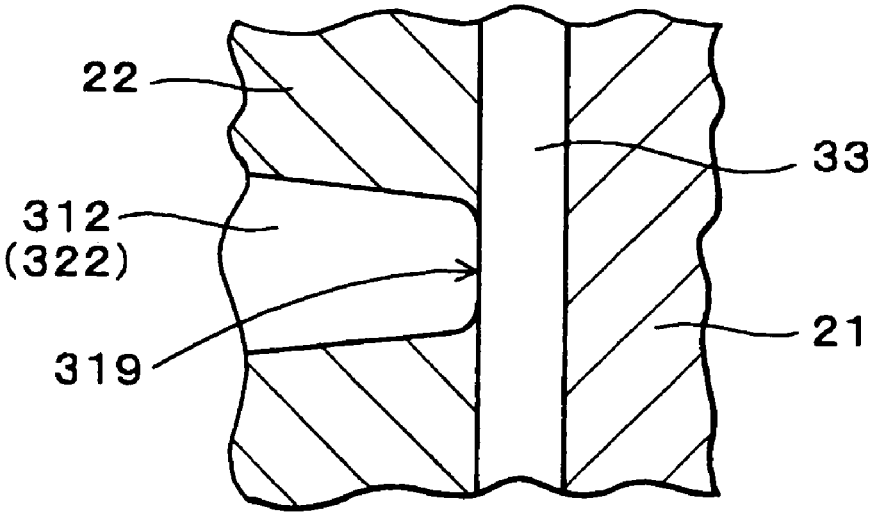
FIG. 9 is a partial sectional view of a constricted parts of a body pin gate and opening pin gate in the first embodiment.

Further, as shown in FIG. 9, the portion where the body pin gate 312 (or opening pin gate 322) connects with the runner 33 is provided with a constricted part 319 where the channel area is greatly locally reduced.

Figure 10:
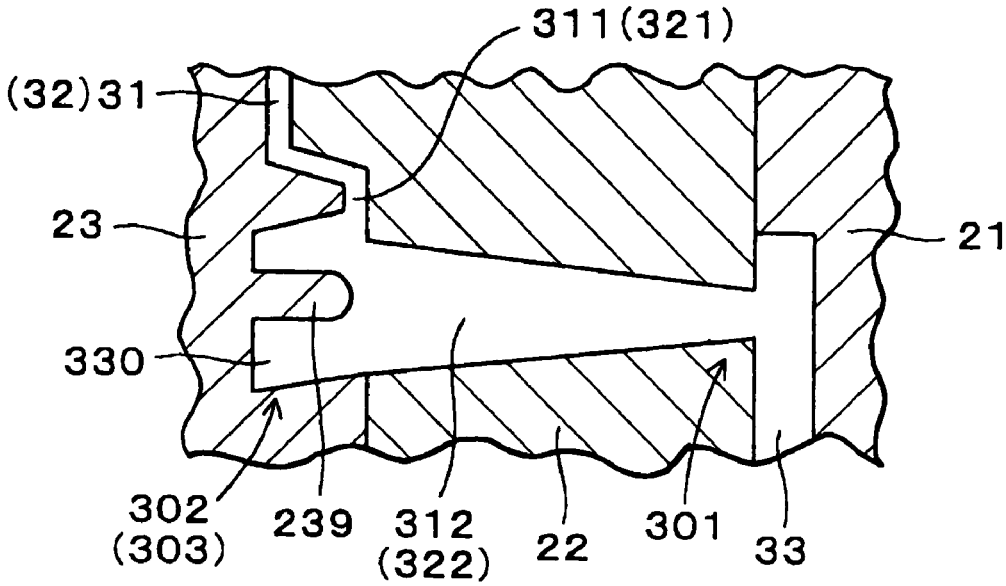
FIG. 10 is a partial sectional view of end part of a body pin gate and opening pin gate in the first embodiment.

As shown in FIG. 10, the end part 302 of the body pin gate 312 (or opening pin gate 322) is provided with a distributer 239 formed by the wall surface of the cavity 3 projecting out toward the inlet 301 of the body pin gate 312 (or opening pin gate 322). In this example, the end part 302 of the body pin gate 312 forms a connecting part 303 connecting with the balance runner 330. The distributer 239 is formed at this connecting part 303. Further, the distributer 239 is formed at the movable mold 33 side at the cavity 3 and is also a projection projecting out toward the direction of the intermediate mold 32.

In this example, to improve the mold releasability, explained later, at least part of the draft at the inner wall of the cavity 3 at the movable mold 23 side, that is, the angle of the side wall in the cavity 3 expanding with respect to the intermediate mold 22, is set to not more than 1°. Further, the draft of the distributer 238 is also set to not more than 1°.

In this example, as shown in FIG. 2, the runner 33 is branched into a body runner 331 for introducing the melt into the body pin gates 312 and an opening runner 332 for introducing the melt into the opening pin gates 322. Further, the body runner 331 and the opening runner 332 are adjusted in inside diameter so that the rates of filling the melt into them become substantially equal.

As shown in the drawing, the opening runner 332 is provided in a shape resembling the shape of the island 121. Specifically, since the island 121 is ring shaped, it is provided in circular curved shape matching with this.

As shown in FIG. 3, the movable mold 21 is provided with a pouring portion 34 connected to the runner 33. The pouring portion 34 has an injection sleeve 342 having a pouring port 343 for pouring the melt and an injection plunger 341 for sending melt poured into the injection sleeve 342 to the runner 33 under pressure.

As shown in the figure, the movable mold 23 is provided with a gas venting passage 35 for discharging gas in the cavity 3 to the outside of the casting mold 2. In the middle of the gas venting passage 35 is provided a pressure reducing means 4 for evacuating the gas in the cavity 3 to reduce the pressure in the cavity 3.

The pressure reducing means 4 is comprised of a vacuum pump 41 and vacuum tank 42.

The melt is poured into the pouring port 343 of the pouring portion 34 and the vacuum pump 41 is actuated to evacuate the inside of the cavity 3 to reduce the pressure in the cavity 3 to a negative pressure. The plunger 341 injects the melt into the runner 33 and fills the cavity 3.

Note that the evacuation by the vacuum pump 41 may also be performed at the time of injection by the plunger 341. Further, the pressure reducing means 4 may also be configured with a chill vent.

The gas vent passage 35 is provided with a cutoff pin 36 so that an excess amount of melt will not flow to the gas venting passage 35 as compared with the volume of the cavity 3 after the melt fills the cavity 3. The passage of the cutoff pin 36 is provided with a vacuum gauge 49 for measuring the vacuum degree in the cavity 3.

The casting mold 2 is comprised of three molds, that is, the fixed mold 21, intermediate mold 22, and movable mold 23, arranged between a pair of base plates 24. Further, a space 25 is provided between the base plate 24 positioned at the movable mold 23 side and the movable mold 23 so that the pin frame 261 of the ejector pins 26 can be arranged there.

Figure 4:
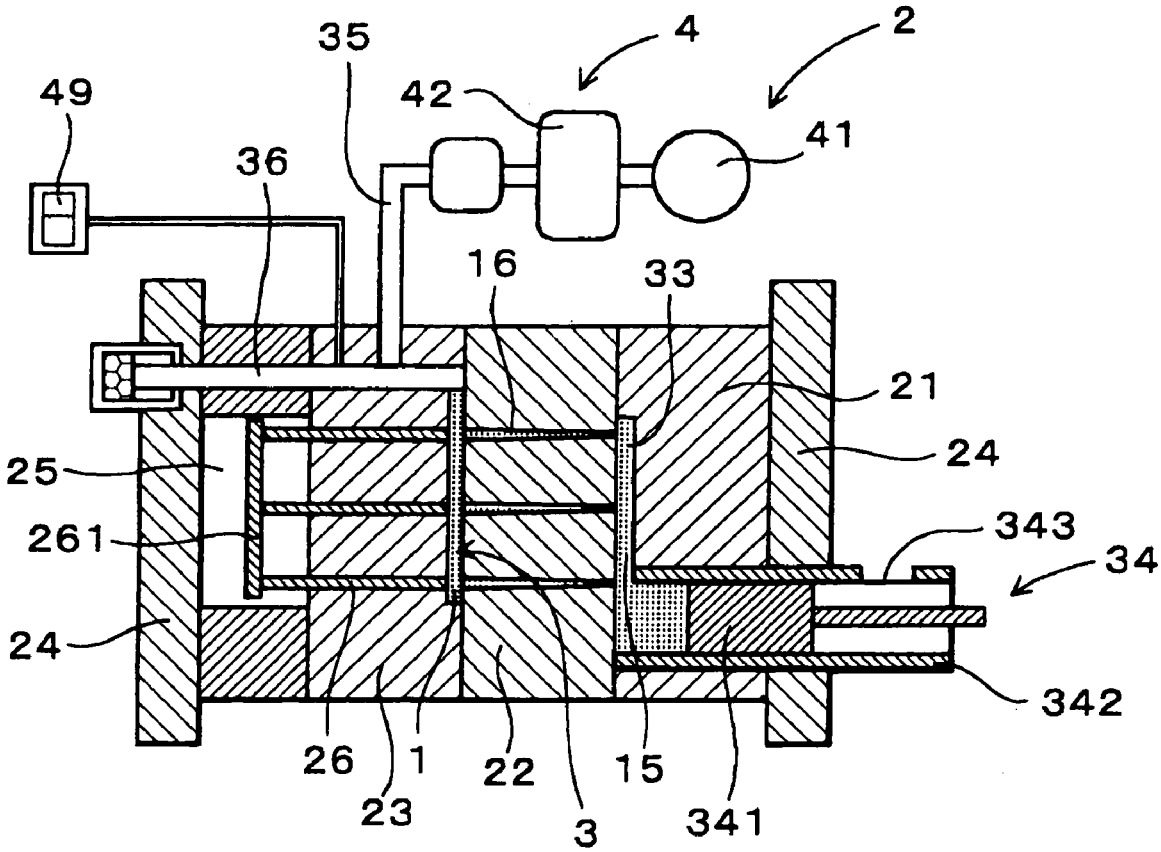
FIG. 4 is a sectional view of the state of the casting mold in the first embodiment being filled with a molten metal.

When producing the casting 1 using the above casting mold 2, first, in the state shown in FIG. 3 and FIG. 4, the melt is poured from the pouring port 343 of the injection sleeve 342 of the pouring portion 34 and the melt is injected to the runner 33 from the injection plunger 341. In the present example, the runner 33, as explained above, is divided into the body runner 331 and the opening runner 332 (see FIG. 2). The melt flows split there.

The melt injected to the body runner 331 is sent under pressure to the body pin gates 312. At this time, the melt flowing through each body pin gate 312 strikes the distributer 239 (see FIG. 10) formed at the end part 302, whereupon the direction of flow is divided into a flow through the body gate 311 and a flow through the balance runner 330. Further, the melt flows from the body gate 311 to the body cavity 31 and flows to the adjoining body gates 311 through the balance runner 330.

On the other hand, the melt injected into the opening runner 332 is sent under pressure to the opening pin gates 322. At this time, the melt flowing through each opening pin gate 322 strikes the distributer 239 formed at the end part 302, where the flow is divided to the multiplely branched balance runner 330. Further, the melt flows from the balance runner 330 through the opening gate 321 into the island/connecting portion cavity 32.

The melt flowing from the opening pin gates 311 to the body cavity 31 fills the body cavity 31 with priority, while the melt flowing from the opening gates 321 to the island/connecting portion cavity 32 fills the island/connecting portion cavity 32 with priority. These melts converge and join at the body cavity 31 or island/connecting portion cavity 32 and fill the cavity 3 as a whole.

The cavity 3 forms a casting 1 having a shape of the above front end panel 10. Further, the runner 33 forms a runner casting 15 having the shape of the runner 33, while the body pin gates 312 and the opening pin gates 322 form pin gate castings 16 having their shapes. Further, the balance runner 330 forms a balance runner casting 17.

Figure 5:
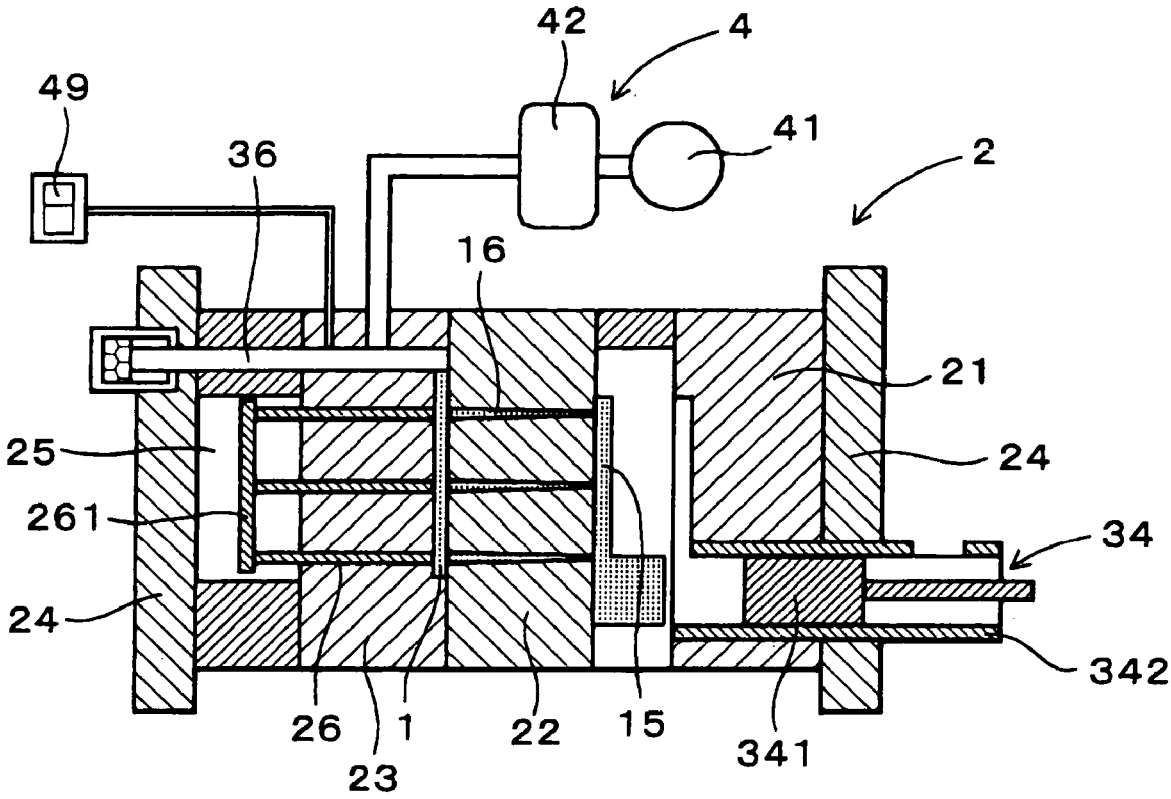
FIG. 5 is a sectional view of the opened state of a fixed mold and intermediate mold of the casting mold in the first embodiment.

As shown in FIG. 5, after the casting 1 is formed the intermediate mold 22 and movable mold 23 are made to move with respect to the fixed mold 21 to release the fixed mold 21 and intermediate mold 22. At this time, the runner casting 15 formed in the runner 33 between the fixed mold 21 and intermediate mold 22 is moved along with the intermediate mold 22 and movable mold 23 while connected to the pin gate castings 16 formed in the body pin gates 312 and opening pin gates 322 in the intermediate mold 22.

Figure 6:
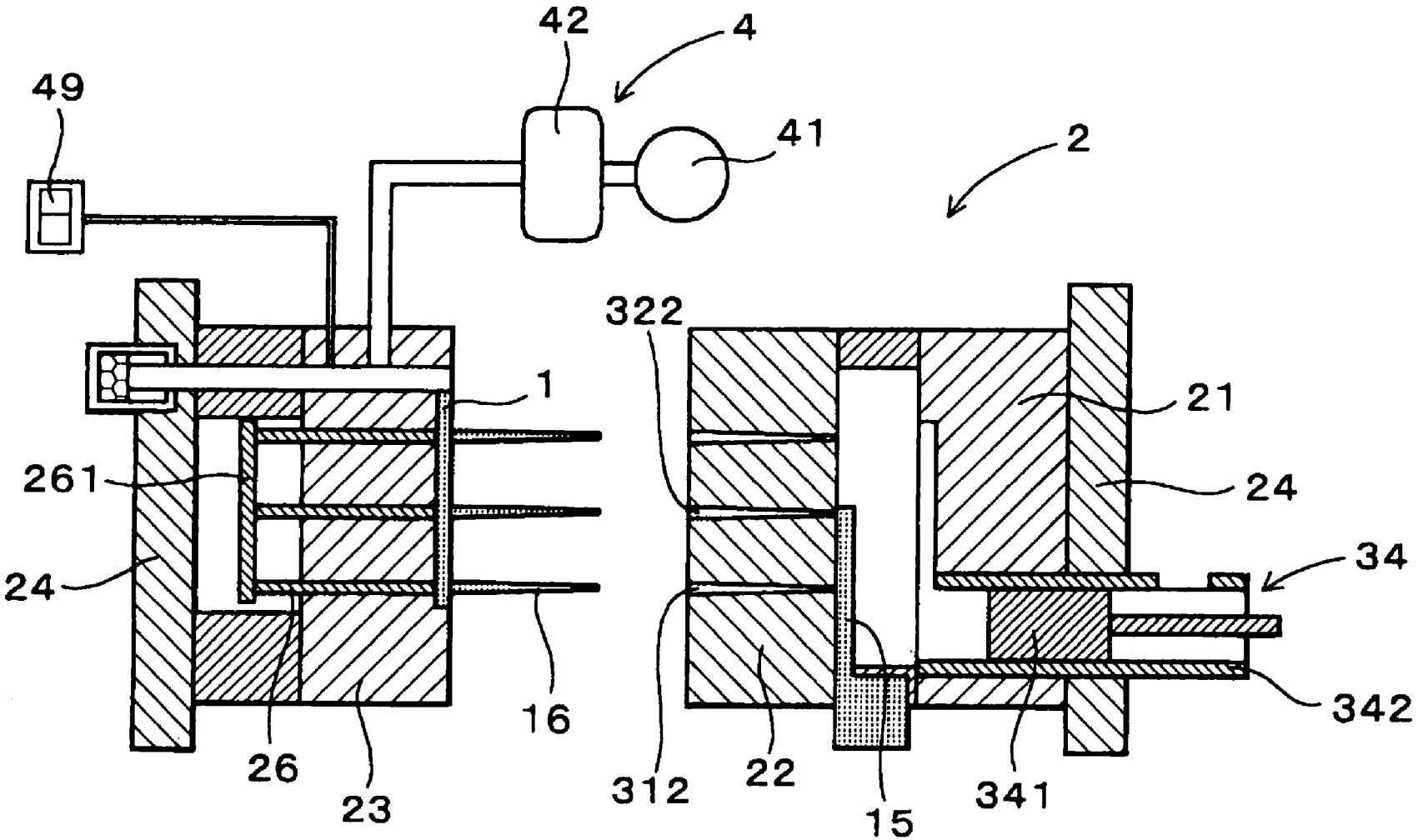
FIG. 6 is a sectional view of the opened state of an intermediate mold and movable mold of the casting mold in the first embodiment.

Next, as shown in FIG. 6, the movable mold 23 is made to move with respect to the intermediate mold 22 to release the intermediate mold 22 and movable mold 23. At this time, the runner casting 15 sticks in the intermediate mold 22 and is cut from the pin gate castings 16. Next, the pin gate castings 16 are released from the intermediate mold 22.

At the time of movement of the movable mold 23, the runner casting 15 and the pin gate castings 16 are easily cut. That is, due to the presence of the constricted parts 319 (see FIG. 9) formed in the body pin gates 312 and opening pin gates 322, stress concentration easily occurs and cutting is easy.

The pin gates 312 and 322 are reversely tapered to expand in channel area toward the cavity 3 as explained above. Therefore, the pin gate castings 16 can also be released from the mold smoothly.

Figure 7:
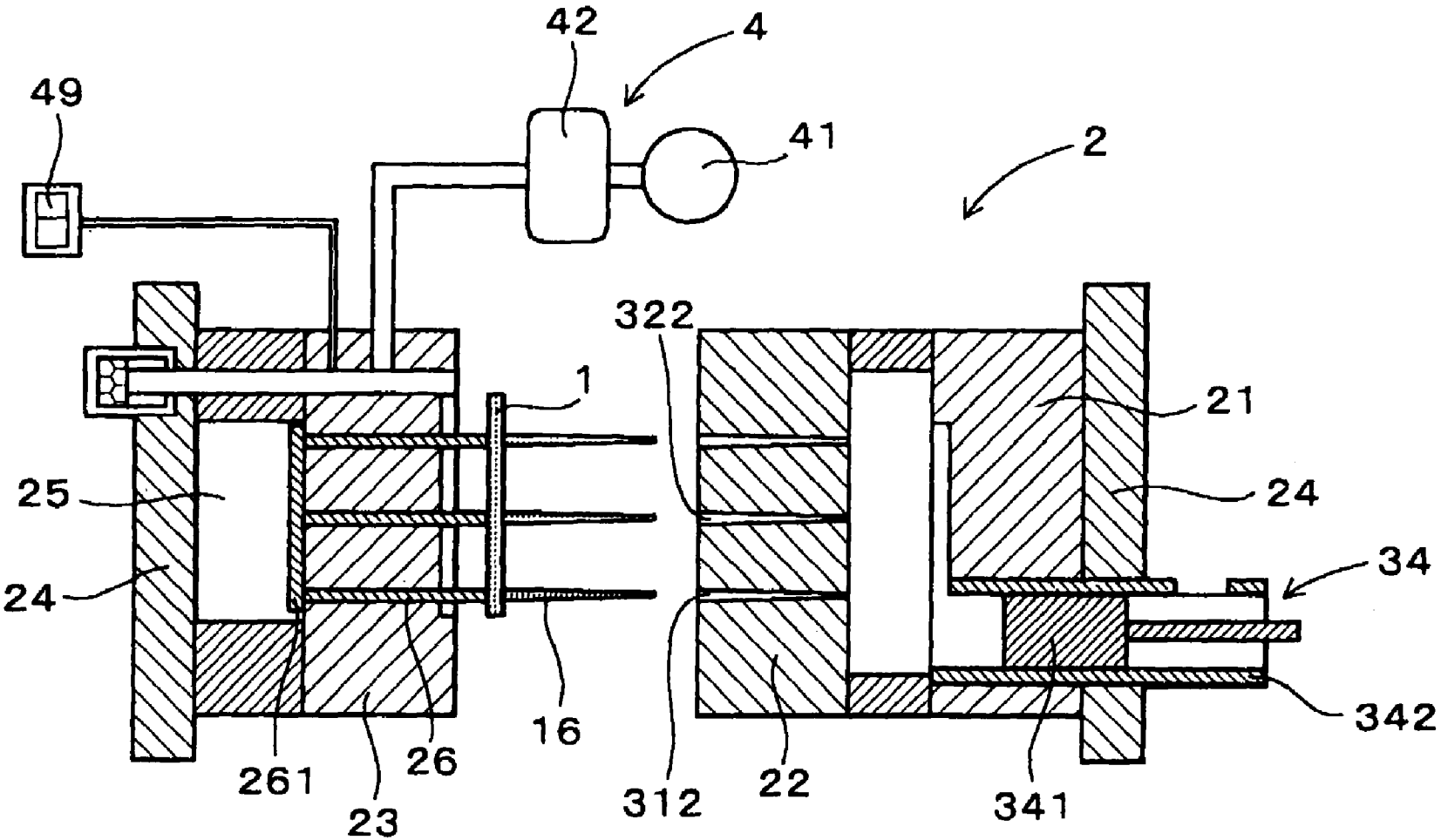
FIG. 7 is a sectional view of the state of separation of the product from the cavity in the first embodiment.

Next, as shown in FIG. 7, the ejector pins 26 arranged corresponding to positions of the body pin gates 312 are made to move toward the direction where the intermediate mold 22 is positioned with respect to the movable mold 23. At this time, the casting 1 is pushed out from the cavity 3 in the state with the pin gate castings 16 connected and the casting 1 can be released from the movable mold 23.

Next, the pin gate castings 16, the balance runner casting 17, and other unnecessary portions are removed from the casting 1 to obtain the final casting 1.

Figure 11:
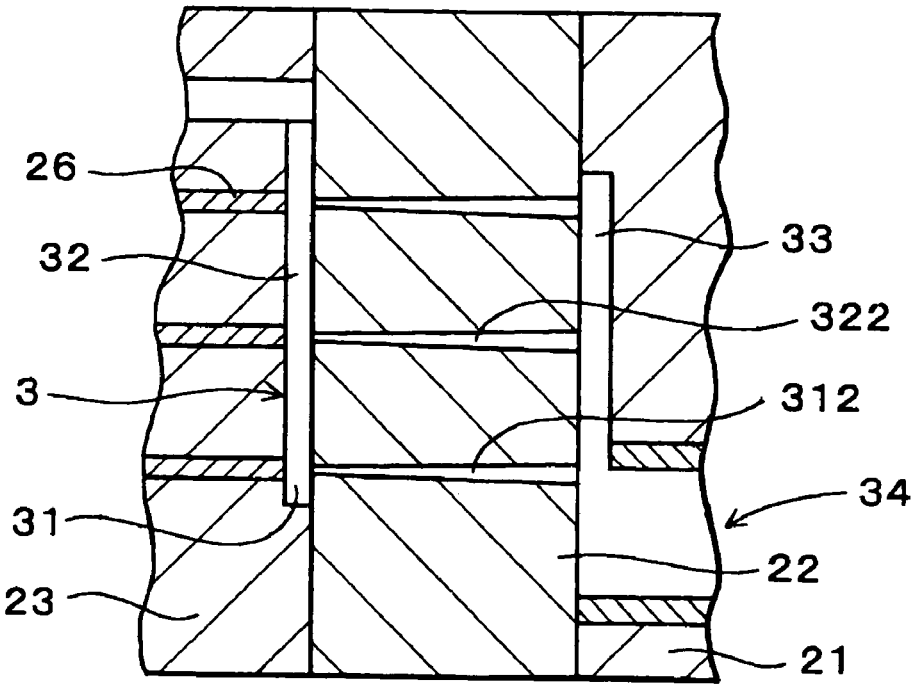
FIG. 11 is a partial sectional view of a casting mold in the case of forming a body pin gate and opening pin gate in the first embodiment reversely tapered to expand in channel area from the movable mold toward the fixed mold.

Note that as shown in FIG. 11, the body pin gates 312 and the opening pin gates 322 may be reversely tapered to expand in channel area from the movable mold 23 toward the fixed mold 21. In this case, when making the movable mold 23 move with respect to the intermediate mold 22, the pin gate castings 16 are cut from the casting 1 in the state with the runner casting 15 connected.

Next, the action and effects of this example will be explained.

As explained above, in this example, use is made of a casting mold 2 providing the body cavity 31 and the island/connecting portion cavity 32 with gates of the body gates 311 and opening gates 321, respectively, and connecting these gates to the runner 33 through the body pin gates 312 and opening pin gates 322.

Therefore, it is possible to easily cast the front end panel 10 for an automobile, a casting 1 having a complicated shape, in a state without casting defects.

That is, the melt supplied into the runner 33 is finally divided into the body gates 311 and the opening gates 321. Further, the melt starts to be filled in the body cavity 31 from the body gates 311, while the melt starts to be filled in the island/connecting portion cavity 32 from the opening gates 321. That is, the melt is sent directly into the body cavity 31 and island/connecting portion cavity 32 through the gates 311 and 321.

Therefore, it is possible to prevent one cavity from being supplied with melt slower than another cavity and possible to directly and quickly fill the melt in both cavities 31 and 32. Due to this, it is possible to prevent melt from being supplied slow and casting defects from appearing.

This superior die casting method is realized by employing the above casting mold 2 of the three-part structure and arranging the cavity 3, gates 311, 321, pin gates 312, 322, and runner 33 three-dimensionally. By using this casting mold 2, it is possible to supply the melt directly to the body cavity 31 and the island/connecting portion cavity 32 and possible to easily release the casting 1 from the mold after casting.

In the above embodiment, it is possible to cast the islands 121 and connecting portions 122 of the front end panel 10 without casting defects and possible to produce a front end panel 10 with a high quality. The front end panel 10, as explained above, can be formed integrally with the body 11, part mounts as the islands 121, and stays as the connecting portions 122 by a single casting operation. For this reason, it is possible to reduce the casting cost.

In the above embodiment, the casting 1 to which the present invention was applied was made a front end panel 10, but the present invention may also be applied to various other products of shapes having islands 121 and connecting portions 122. Also, the casting 1 was explained as being made of a metal, but the present invention may also be applied to various other materials.

In the above embodiment, a method for filling a melt into a cavity 3 through body gates 311 and opening gates 321 and a casting mold 2 used for the same were explained. When casting a product 1, however, it is also possible to use a method of filling a melt into the cavity 3 from only the opening gates 321 using a casting mold 2 provided with only opening gates 321.

Figure 12:
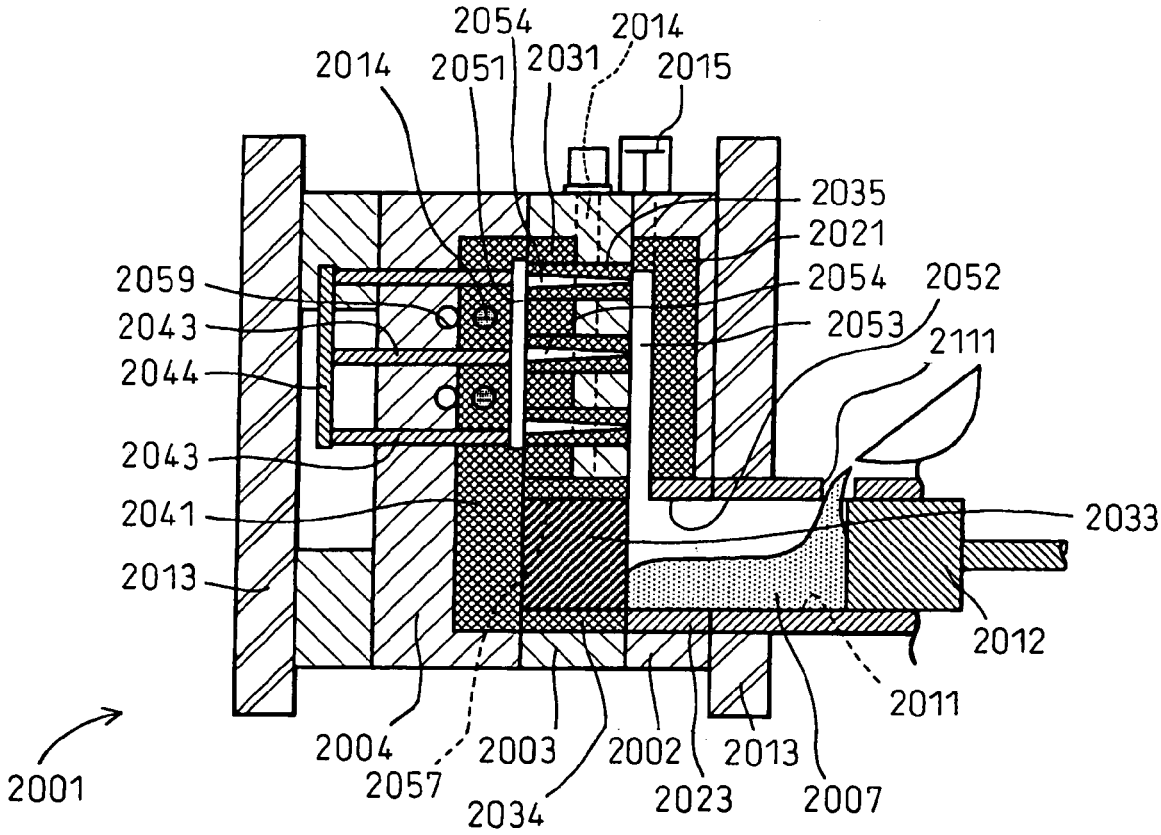
FIG. 12 is an explanatory view of a three-part mold structure die casting mold in a state with a melt injected in a second embodiment.

The three-part mold structure die casting mold 2001, as shown in FIG. 12, has a fixed mold 2002 having a connection sleeve 2052 connecting to an injection sleeve injecting a melt 2007, an intermediate mold 2003 able to move relative to the fixed mold 2002, and a movable mold 2004 able to move relative to the intermediate mold 2003. Further, the die casting mold 2001 has a first cavity 2051 filled with the melt 2007 to form a first die casting 2061 between the intermediate mold 2003 and movable mold 2004. Further, the fixed mold 2002 and the intermediate mold 2003 have between them a first runner 2053 connected to the connection sleeve 2052. The intermediate mold 2003 has inside it a pin gate 2054 connecting the first runner 2053 and the first cavity 2051.

Figure 17:
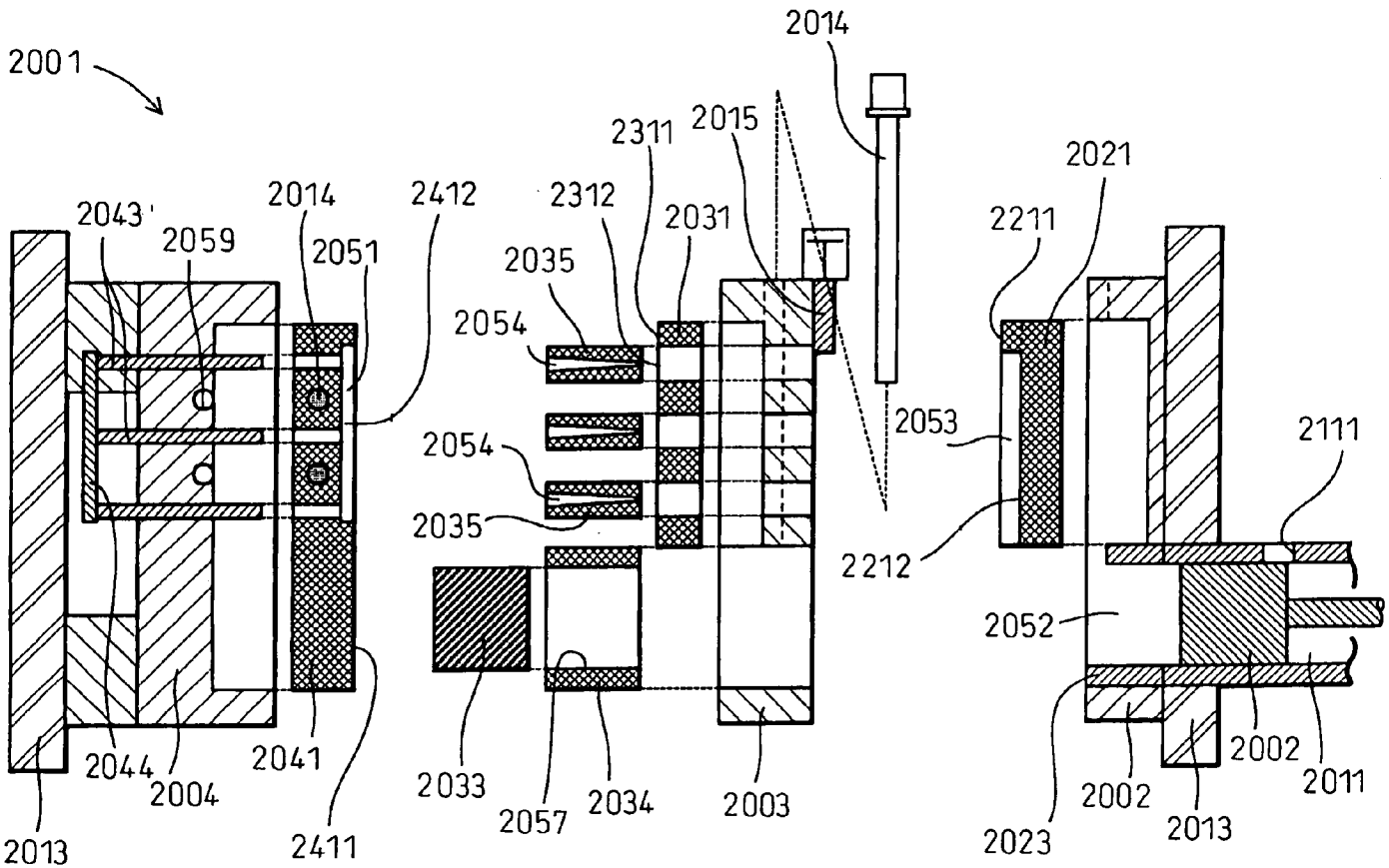
FIG. 17 is an explanatory view of a three-part mold structure die casting mold in a state with the parts disassembled in the second embodiment.

Further, as shown in FIG. 12 and FIG. 17, the intermediate mold 2003 is formed with an extension sleeve 2057 provided on an extension of the connection sleeve 2052, and the extension sleeve 2057 has an extension sleeve insert 2033 inserted in it for filling the same.

Further, the first cavity 2051 is formed between an intermediate mold first insert 2031 inserted detachably with respect to the intermediate mold 2003 and a movable mold first insert 2041 inserted detachably with respect to the movable mold 2004.

Figure 18:
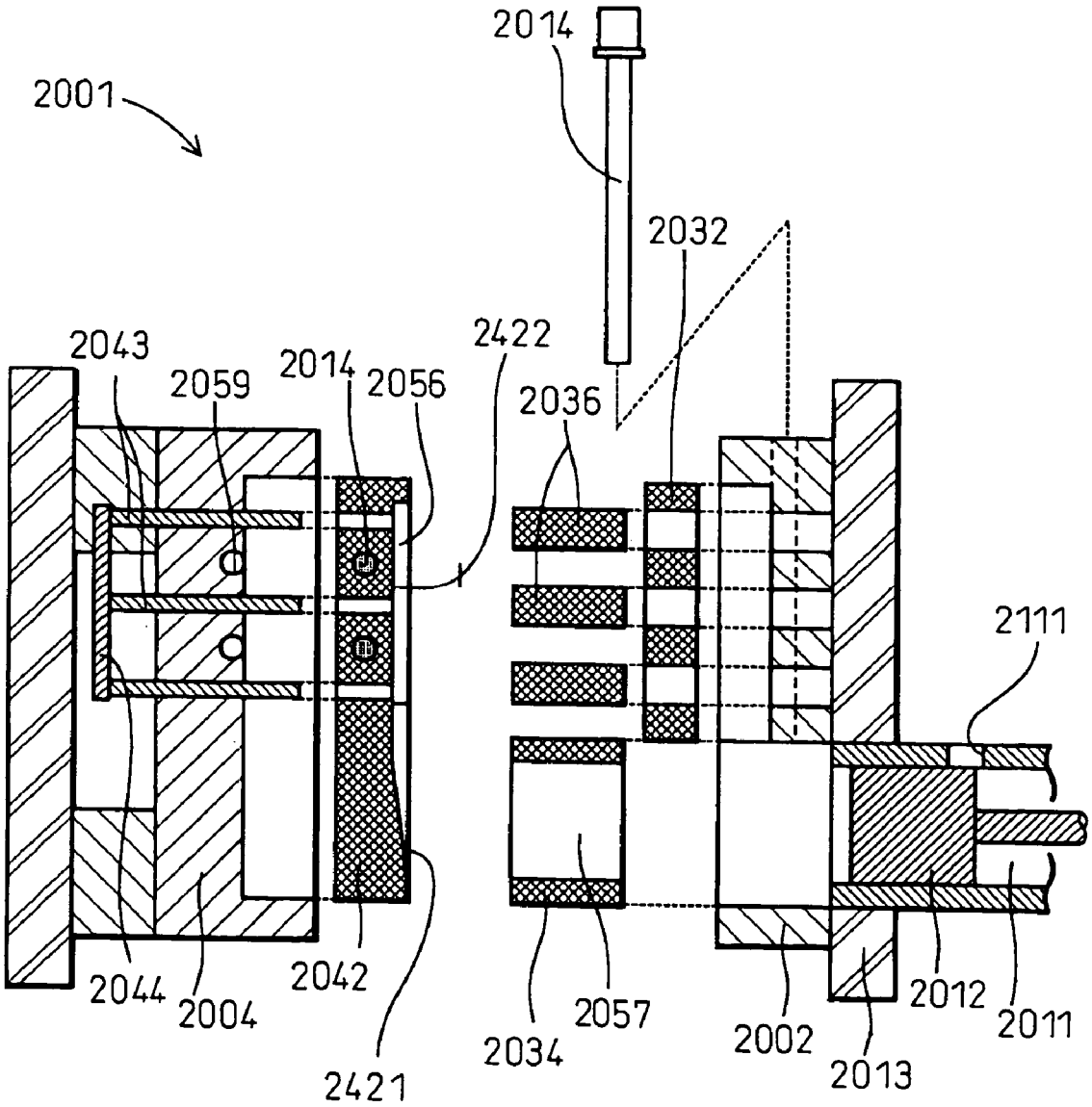
FIG. 18 is an explanatory view of a two-part mold structure die casting mold in a state with the parts disassembled; in the second embodiment.

The die casting mold 2001 can be changed from the three-part mold structure to a two-part mold structure using the intermediate mold 2003 and the movable mold 2004 by replacing and rearranging the following inserts. That is, when forming the two-part mold structure, as shown in FIG. 18, the fixed mold 2002 is removed and the extension sleeve insert 2003 inserted in the extension sleeve 2057 is removed. Further, a pin gate insert 2036 for insertion into the intermediate mold 2003 is used to fill the pin gate 2054. In addition, the intermediate mold first insert 2031 and the movable mold first insert 2041 are replaced with an intermediate mold second insert 2032 and movable mold second insert 2042.

Figure 19:
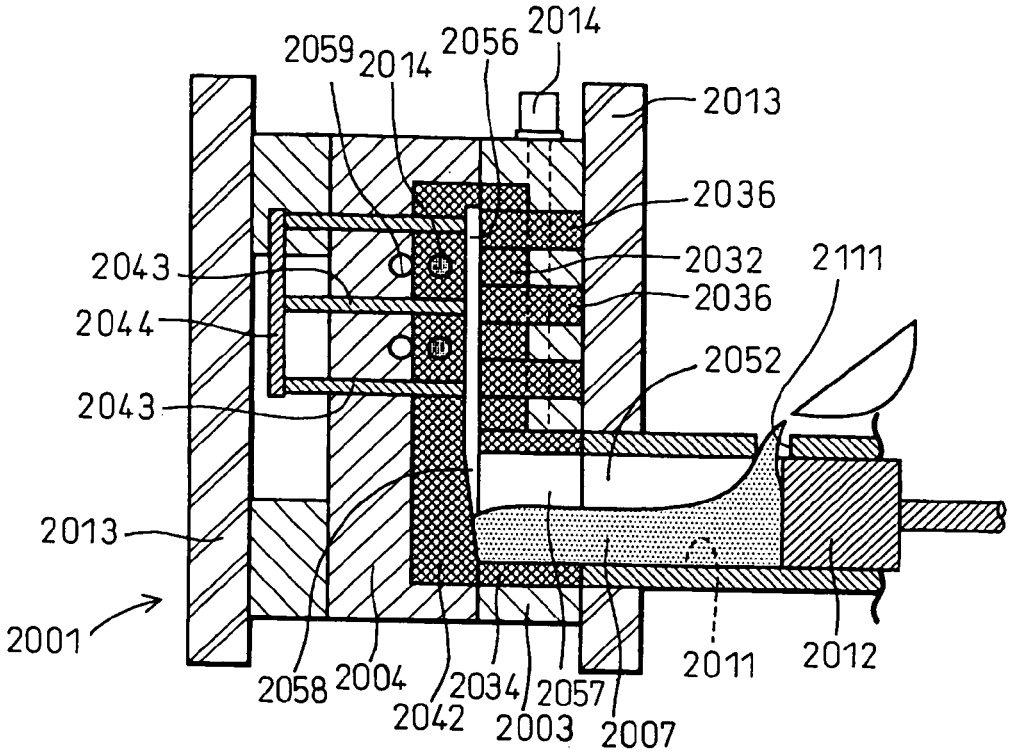
FIG. 19 is an explanatory view of a two-part mold structure die casting mold in a state with the melt injected in the second embodiment.

Due to this, as shown in FIG. 19, a second cavity 2056 forming a second die casting 2062 is formed, and a second runner 2058 formed between the intermediate mold second insert 2032 and the movable mold second insert 2042 is used to connect the extension sleeve 2057 and second cavity 2056.

In this way, it is possible to form a two-part mold structure die casting mold 2001 moving the movable mold 2004 relative to the intermediate mold 2003.

Next, the first die casting 2061 and the second die casting 2062 will be explained in detail.

Figure 23:
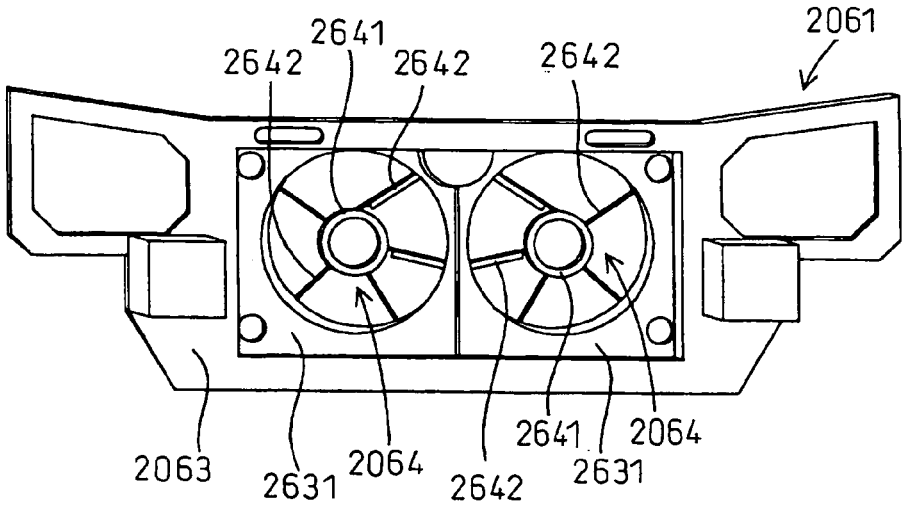
FIG. 23 is an explanatory view of a first die casting in the second embodiment.

As shown in FIG. 23, each of the first and second die castings 2061 and 2062 formed by the die casting mold 2001 is a front end panel forming part of an automobile frame. The front end panel is a frame part for attachment of a radiator, condenser, bumper, lights, etc. at the front of an automobile. Further, the front end panel also has the function of an engine support for supporting the engine of the automobile.

The die casting mold 2001 is used for die casting aluminum to form an aluminum front end panel.

As shown in the figures, the first front end panel formed in the first cavity 2051 in the three-part mold structure die casting mold 2001 (first die casting 2061) has a body 2063, an opening 2064 provided so as to pass through the body 2063, an island 2641 arranged away from the body 2063 in the opening 2064, and a connecting portion 2642 connecting the island 2641 and the body 2063. The opening 2064 is a portion for attachment of a fan, while the island 2641 is a portion for attachment of the fan motor. The connecting portion 2642 is a stay for supporting the fan motor. Further, the opening 2064 is formed around it with a surround 2631 having a smooth curved surface.

Figure 24:
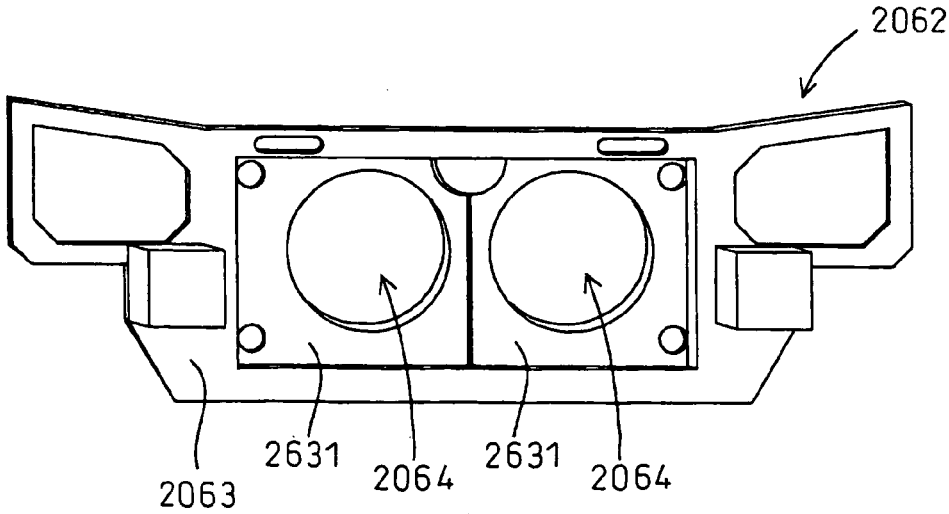
FIG. 24 is an explanatory view of a first die casting in the second embodiment.

As shown in FIG. 24, the second front end panel formed in the second cavity 2056 in the two-part mold structure die casting mold 2001 (second die casting 2062) does not have the island 2641 and connecting portion 2642. The rest of the configuration is similar to that of the first front end panel.

Next, the three-part mold structure die casting mold 2001 will be explained in detail.

Figure 25:
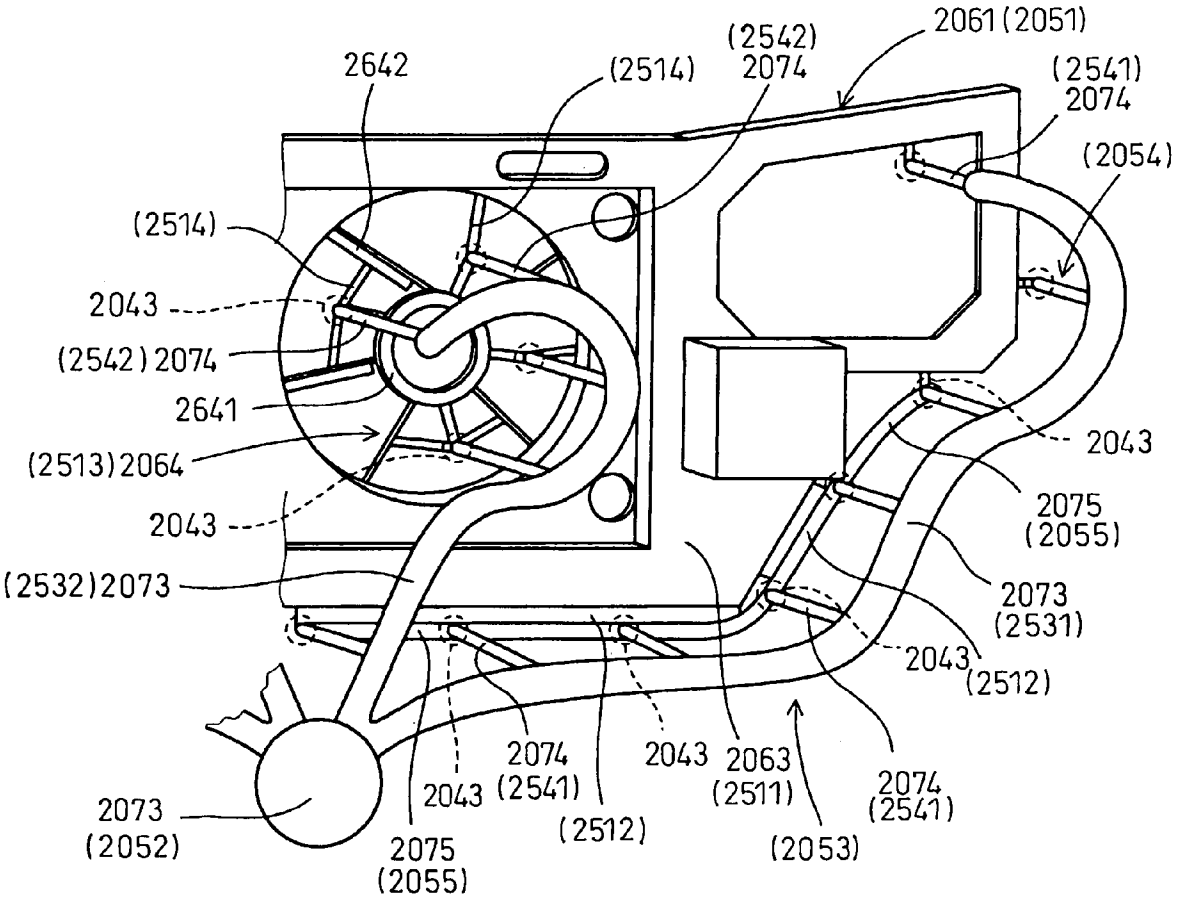
FIG. 25 is a perspective explanatory view showing a first die casting and showing a first cavity, connection sleeve, first runner, pin gate, etc. in the second embodiment.

FIG. 25 is an explanatory view of the state where part of the first die casting 2061 formed in the first cavity 2051 in the two-part mold structure die casting mold 2001 and the castings 2073, 2074 formed in the path of the melt 2007 at the time of die casting are connected. The first cavity 2051, first runner 2053, part of the connection sleeve 2052 (shown in parentheses in FIG. 25), and other parts in the die casting mold 2001 are illustrated in this figure.

As shown in the figure, the first cavity 2051 is comprised of a body cavity 2511 for forming the body 2063 of the first die casting 2061 and an opening cavity 2513 for forming the island 2641 and connecting portion 2642 in the opening 2064 of the first die casting 2061.

The first runner 2053 is comprised of a body runner 2531 for guiding the melt 2007 to the body cavity 2511 and an opening runner 2532 for guiding the melt 2007 to the opening cavity 2513. Further, the body runner 2531 is formed along the outer shape of the body cavity 2511, while the opening cavity 2532 has a front end part formed in an arc mimicking the circular shape of the opening 2064.

As shown in FIG. 25, the pin gate 2054 is comprised of a body pin gate 2541 opening to the body runner 2531 and an opening pin gate 2542 opening to the opening runner 2532. Pluralities of these pin gates 2541 and 2542 are provided to guide the melt 2007 as uniformly as possible to the body cavity 2511 or opening cavity 2513.

Further, as shown in FIG. 12, the pin gates 2541 and 2542 are formed into tapered shapes from the fixed mold 2002 to the movable mold 2004, that is, increasing in channel area toward the first cavity 2051.

As shown in FIG. 25, the body cavity 2511 and the opening cavity 2513 are respectively formed with a body gate 2512 and opening gate 2514 forming inlets for the melt 2007. Pluralities of these gates 2512 and 2514 are formed. Further, the body cavity 2511 has a body gate 2512 of a longer length than the later explained balance runner 2055 connected to it. The opening cavity 2513 has the opening gate 2514 branched into several parts from the opening pin gate 2542 connected to it.

Further, the plurality of body pin gates 2541 open to the side of the body cavity 2511, that is, the balance runner 2055 provided between the intermediate mold 2003 and movable mold 2004. The balance runner 2055 is for ensuring that the melt 2007 flowing through the plurality of body pin gates 2541 be filled from the body gates 2512 to the body cavity 2511 as close in timing as possible.

The melt 2007 flowing through the body runner 2531 flows through the plurality of body pin gates 2541 to the balance runner 2055 and is filled from the balance runner 2055 into the body cavity 2511 through the body gates 2512.

Further, the plurality of opening gates 2514 are formed at the side of the opening cavity 2513, that is, between the intermediate mold 2003 and the movable mold 2004. The melt 2007 flowing through the opening runner 2532 flows branched to the opening gates 2514 from the plurality of opening pin gates 2542 and is filled in the opening cavity 2513 through the opening gates 2514.

As shown in FIG. 17, the pin gates 2054 are formed inside the pin gate inserts 2035 inserted detachably with respect to the intermediate mold 2003. Further, the first runner 2053 is formed at the fixed mold first insert 2021 inserted detachably with respect to the fixed mold 2002.

Further, the extension sleeve insert 2033 is formed in the intermediate sleeve insert 2034 inserted detachably with respect to the intermediate mold 2003.

Further, the connection sleeve 2052 is formed in the fixed mold sleeve insert 2023 inserted detachably at the fixed mold 2002 and is connected with an injection sleeve 2011.

The injection sleeve 2011 is communicated with an injection port 2111 for injecting the melt 2007. The injection sleeve 2011 is provided with an injection plunger 2011 for injecting the melt 2007 injected into the injection sleeve 2011 toward the first cavity 2051 or the second cavity 2056.

Note that as illustrated, the first cavity 2051 is formed by facing recesses 2312 and 2412 provided at a facing surface 2311 facing the movable mold first insert 2041 at the intermediate mold first insert 2031 and a facing surface 2411 facing the intermediate mold first insert 2031 at the movable mold first insert 2041. The same is true for the later explained second cavity 2056.

The first runner 2053 is formed from a recess 2212 formed in the facing surface 2211 facing the intermediate mold 2003 in the movable mold first insert 2021.

Further, as shown in FIG. 12, the movable mold 2004 is provided with a plurality of ejector pins 2043 for ejecting die castings 2061, 2062 formed at the first cavity 2051 or second cavity 2056 from the first cavity 2051 or second cavity 2052. The plurality of ejector pins 2043 are provided at a plurality of ejector plates 2044. While the illustration is omitted, the positions of the ejector pins 2043 used when forming the three-part mold structure and when forming the two-part mold structure differ. The ejector plates 2044 are therefore comprised of a plurality of parts. The ejector plates 2044 are designed to be moved by a pressurizing means (not shown).

The movable mold 2004 is provided with a usage pin changing means (not shown) for changing the ejector pins 2043 used among the plurality of ejector pins 2043 between when forming the three-part mold structure and when forming the two-part mold structure. The usage pin changing means is a connecting means for connecting and releasing the plurality of ejector plates 2044.

As shown in FIG. 25, when forming the three-part mold structure, the plurality of ejector pins 2043 (shown by the broken lines in FIG. 25) include ones contacting the balance runner 2055 etc. connected to the body pin gate 2541 and ones contacting the casting formed in the opening gate 2514 or the pin gate casting 2074 etc. formed in the opening pin gate 2542. Further, most of the ejector pins 2043 contacting the balance runner 2055 etc. can be made to contact positions corresponding to the pin gate casting 2074 formed in the body pin gate 2541 at the balance runner 2055.

Figure 26:
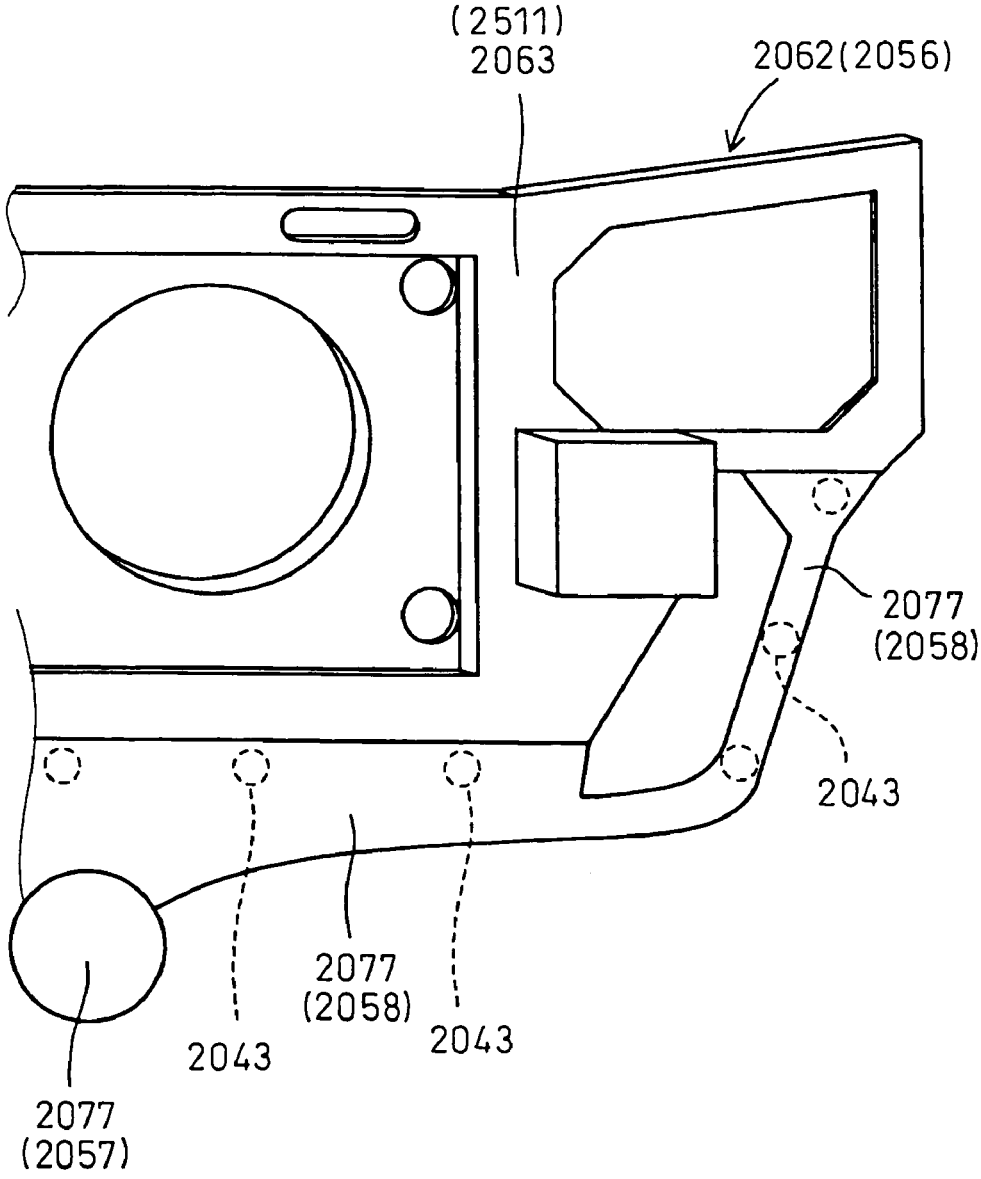
FIG. 26 is a perspective explanatory view showing a second die casting and showing a second cavity, extension sleeve, second runner, in the second embodiment.

On the other hand, as shown in FIG. 26, when forming the two-part mold structure, the plurality of ejector pins 2043 (shown by the broken lines in FIG. 26) are designed to contact the second runner casting 2077 formed at parts of the second runner 2058 and the extension sleeve 2057.

As shown in FIG. 12, around the first cavity 2051, the three-part mold structure die casting mold 2001 has a burner unit 2014 for adjusting the surface temperature at the first cavity 2051.

The first cavity 2051 further has formed around it a plurality of insertion and positioning holes 2059 enabling the insertion and positioning of the burner unit 2014. The burner unit 2014 can be arranged between the insertion and positioning holes 2059.

When the surface temperature of the first cavity 2051 is low before casting or at the start of casting (stage when number of castings is still small), it is possible to use the burner unit 2014 to heat the surface of the first cavity 2051 to a temperature suitable for casting (for example, 150 to 250° C.). Further, the burner unit 2014 can be changed in position between the insertion and positioning holes 2059 to enable the surface temperature of the first cavity 2051 to be adjusted more suitably.

Note that the effect of the burner unit 2014 is similarly obtained when forming the second cavity 2056 in the two-part mold structure die casting mold 2001.

Further, as shown in FIG. 12 and FIG. 17, the intermediate mold 2003 is provided with a pressurizing cylinder 2015 able to pressurize the first runner sleeve casting 2073 cast in the first runner 2053 and part of the connection sleeve 2052. Further, the pressurizing cylinder 2015 may be used to pressurize the first runner sleeve casting 2073 and cut this from the pin gate casting 2074 formed in the pin gate 2054 when releasing the first runner sleeve casting 2073 from the intermediate mold 2003 when forming the three-part mold structure. Due to this, it is possible to reliably release the first runner sleeve casting 2073 from the pin gate casting 2074.

Further, while not shown, the die casting mold 2001 when forming the three-part mold structure and when forming the two-part mold structure, in the same way as the conventional die casting mold, has a vacuum system for evacuating the first cavity 2051 or the second cavity 2056 to a vacuum state. Further, the die casting mold 2001 has a gas vent for venting gas from the first cavity 2051 or second cavity 2056, a cutoff pin for preventing an excessive amount of melt 2007 compared with the volume of the first cavity 2051 or second cavity 2056 from leaking out to the gas vent, etc.

Further, the fixed mold 2002 and the movable mold 2004 are fixed to a base plate 2013. The die casting mold 2001 is provided at a die casting machine (not shown) and enables movement of the intermediate mold 2003 and the movable mold 2004.

Note that here, the pressurizing cylinder 2015 is provided at the intermediate mold 2003, but it may also be provided at the above die casting machine of course.

Next, FIG. 12 to FIG. 16 and FIG. 15 will be used to explain the method for forming the first die casting 2061 by the three-part mold structure die casting mold 2001.

Figure 13:
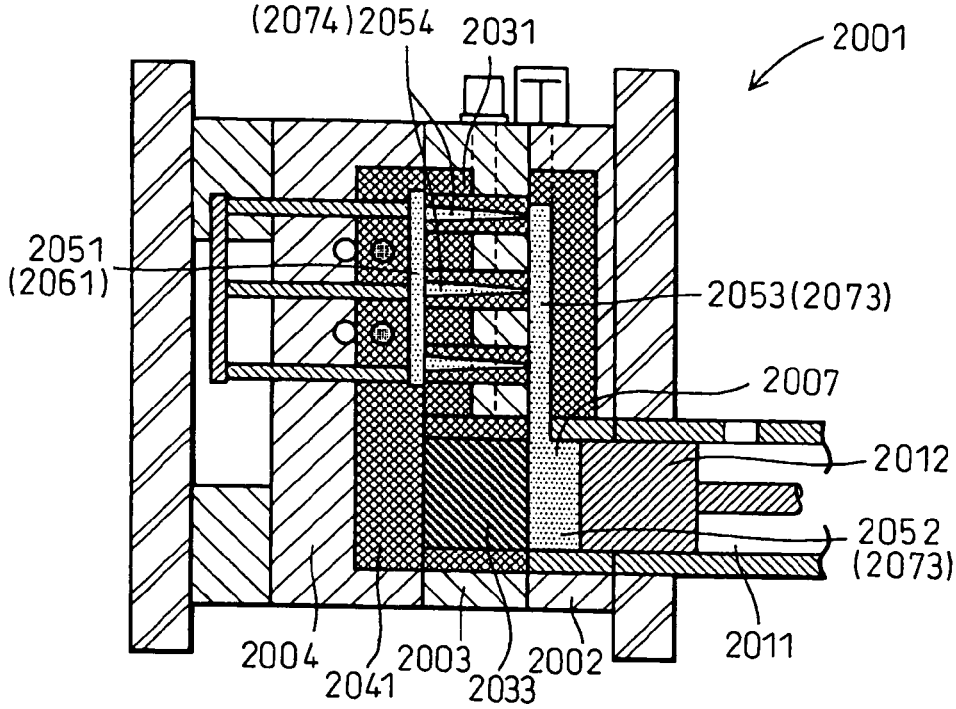
FIG. 13 is an explanatory view of a three-part mold structure die casting mold in a state with a melt injected in the second embodiment.

As shown in FIG. 12, first, the melt 2007 is injected through the injection port 2111 into the injection sleeve 2011 and the connection sleeve 2052. As shown in FIG. 13, the melt 2007 is injected from the injection plunger 2012 into the first runner 2053, that is, the body runner 2531 and the opening runner 2532.

The melt 2007, as shown in FIG. 25, flows through the body pin gate 2541 and the balance runner 2055 from the body runner 2531 and fills the body cavity 2511 from the body gate 2512. Further, the melt 2007 flows through the opening pin gate 2542 from the opening runner 2532 and fills the opening cavity 2513 from the opening gate 2514.

In this way, as shown in the figure, the melt 2007 can directly fill both the body cavity 2511 and the opening cavity 2513. Therefore, in particular, it is possible to fill the melt 2007 on a priority basis in the opening cavity 2513 where the sectional area of the path is small and the melt 2007 has difficulty flowing.

Therefore, even when filling the melt 2007 in the complicatedly shaped opening cavity 2513 for forming the island 2641 and connecting portion 2642, it is possible to prevent casting defects etc. and form a high quality first die casting 2061 by forming the three-part mold structure forming the pin gate 2054.

Further, melt is cast into the first cavity 2051 to form the first die casting 2061 having the shape of the first front end panel. The first runner 2053 and part of the connection sleeve 2052 are formed with a first runner sleeve casting 2073 corresponding to their shapes, while pin gates 2541 and 2542 are formed with pin gate castings corresponding to their shapes. Further, the balance runner 2055 is formed with a balance runner casting 2075.

Figure 14:
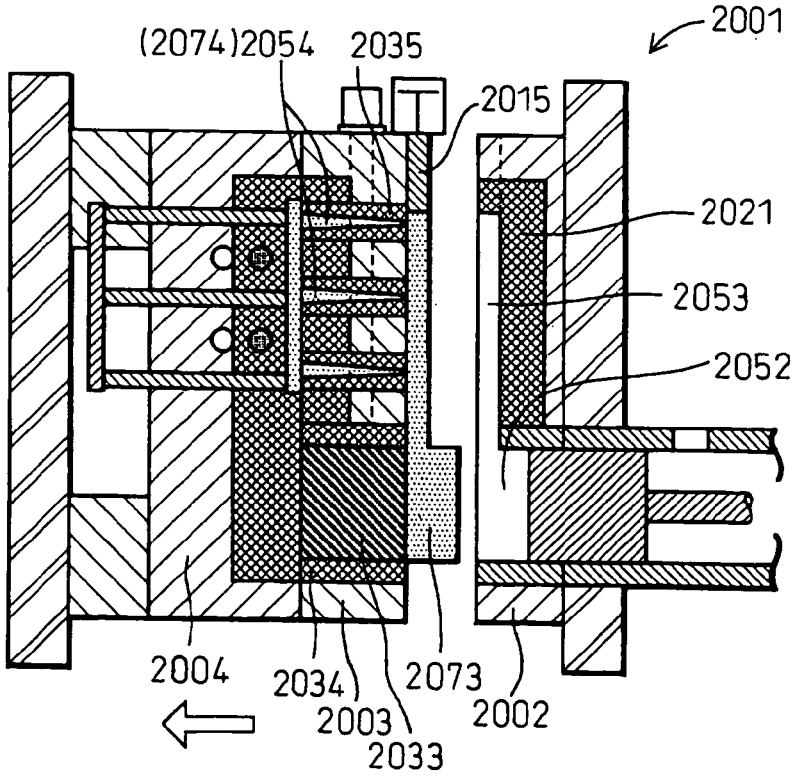
FIG. 14 is an explanatory view of a three-part mold structure die casting mold in a state with the intermediate mold and movable mold moved with respect to the fixed mold in the second embodiment.

Next, after forming the first die casting 2061, as shown in FIG. 14, the intermediate mold 2003 and the movable mold 2004 are moved integrally with respect to the fixed mold 2002 to open the fixed mold 2002 and the intermediate mold 2003. At this time, the first runner sleeve casting 2073 moves together with the intermediate mold 2003 and the movable mold 2004 while connected with the pin gate casting 2074.

Figure 15:
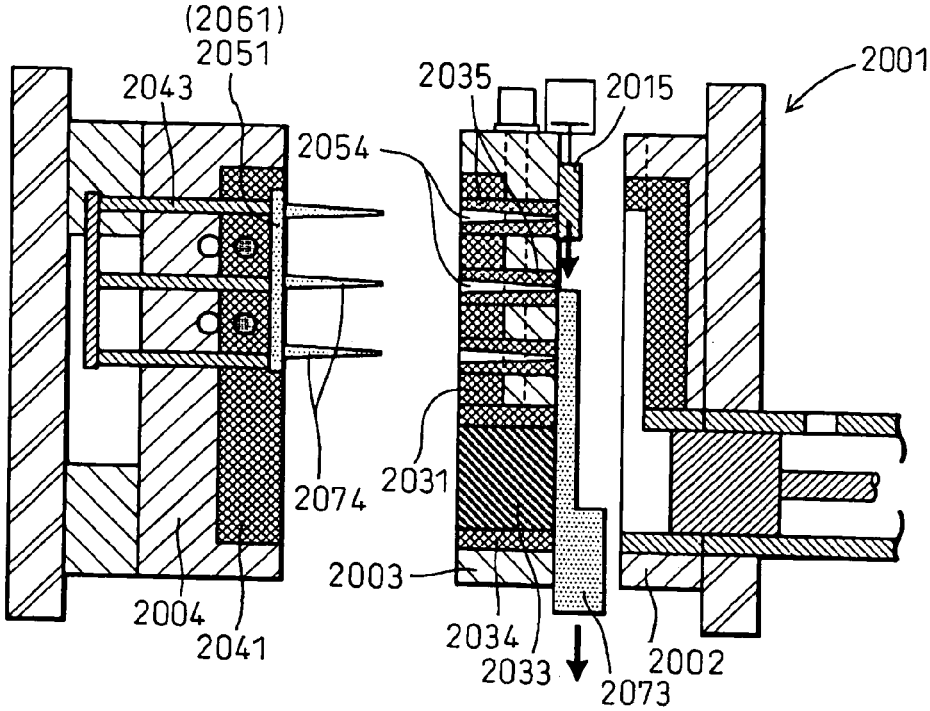
FIG. 15 is an explanatory view of a three-part mold structure die casting mold in a state with a first runner sleeve casting cut and with the movable mold moved with respect to the intermediate mold in the second embodiment.

Next, as shown in FIG. 15, the pressurizing cylinder 2015 in the intermediate mold 2003 is used to pressurize the first runner sleeve casting 2073 and cut it off from the pin gate castings 2074.

Next, as illustrated, the movable mold 2004 is moved with respect to the intermediate mold 2003 to open the intermediate mold 2003 and the movable mold 2004. At this time, the pin gate castings 2074 are released from the intermediate mold 2003. The pin gate castings 2074, the balance runner casting 2075, and the first die casting 2061 move together with the movable mold 2004. The pin gate castings 2074 are smoothly released by shaping the pin gates 2541 and 2542 tapered shapes with channel areas increasing along the first cavity 2051.

Note that to reliably cut the first runner sleeve casting 2073 from the pin gate castings 2074, the pressurizing cylinder 2015 is used for cutting. As opposed to this, this cutting may also be performed by hooking the first runner sleeve casting 2073 at the intermediate mold 2003 when moving the movable mold 2004 from the intermediate mold 2003.

Figure 16:
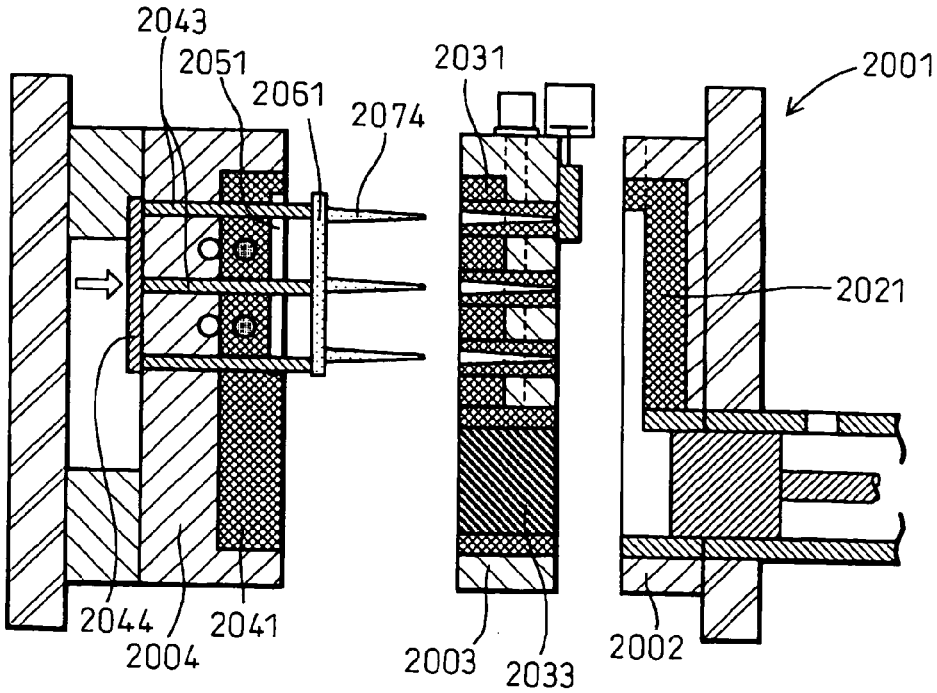
FIG. 16 is an explanatory view of a three-part mold structure die casting mold in a state with a first die casting ejected by ejector pins in the second embodiment.

Next, as shown in FIG. 16, the plurality of ejector pins 2043 provided at the ejector plates 2044 are simultaneously moved. The first die casting 2061 with the pin gate castings 2074 connected to it is released from the movable mold 2004. Next, as shown in FIG. 23, the pin gate castings 2074 and balance runner casting 2075 and other unnecessary parts are removed from the first die casting 2061 to obtain the final first die casting 2061.

Next, the method of forming the two-part mold structure die casting mold 2001 (see FIG. 18) using the three-part mold structure die casting mold 2001 (see FIG. 17) will be explained.

As shown in FIG. 18, when forming the two-part mold structure die casting mold 2001, the fixed mold 2002 is removed from the base plate 2013 and instead the intermediate mold 2003 is attached to the base plate 2013. Further, the pin gate inserts 2035 forming the pin gates 2054 are removed from the intermediate mold 2003 and instead the pin gate inserts 2036 not forming pin gates 2054 are inserted into the intermediate mold 2003. Due to this, the pin gates 2054 are filled.

Further, the extension sleeve insert 2033 is removed from the intermediate mold 2003 and the extension sleeve 2057 connected to the connection sleeve 2052 is formed at the intermediate mold 2003.

Further, the intermediate mold first insert 2031 and the movable mold first insert 2041 for forming the first cavity 2051 are replaced with the intermediate mold second insert 2032 and another movable mold second insert 2042 for forming the second cavity 2056.

The second runner 2058 is formed by a recess 2422 formed in a facing surface 2421 facing the intermediate mold 2003 at the movable mold second insert 2042.

In this way, as shown in FIG. 19, it is possible to form a path for the melt 2007 communicating from the connection sleeve 2052 to the second cavity 2056 through the extension sleeve 2057 and the second runner 2058 and possible to form a two-part mold structure die casting mold 2001 moving the movable mold 2004 with respect to the intermediate mold 2003.

FIG. 26 is an explanatory view of the state of part of the second die casting 2062 formed in the second cavity 2056 at the two-part mold structure die casting mold 2001 and the castings 2075 and 2077 formed in the path of the melt 2007 at the time of die casting connected together. The second cavity 2056, second runner 2058, extension sleeve 2057 (shown by parentheses in FIG. 26), and other parts of the die casting mold 2001 are also shown in the figure.

Next, the method of forming the second die casting 2062 by the two-part mold structure die casting mold will be explained in detail using FIG. 19 to FIG. 22 and FIG. 26.

Figure 20:
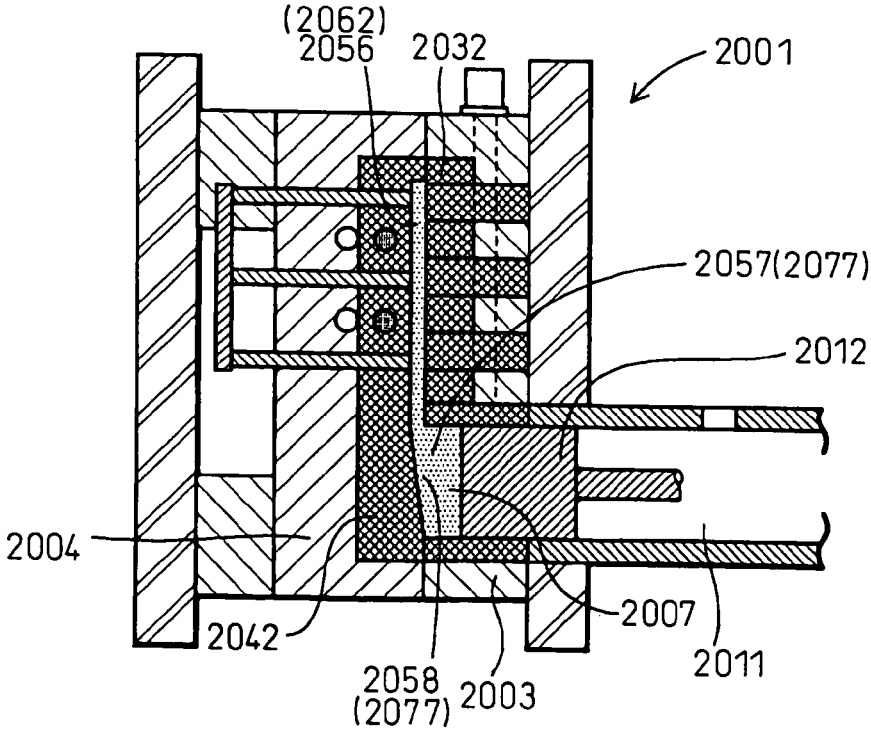
FIG. 20 is an explanatory view of a two-part mold structure die casting mold in a state with the melt injected in the second embodiment.

As shown in FIG. 19, first, the melt 2007 is injected into the injection sleeve 2011 and extension sleeve 2057 through the injection port 2111. Further, as shown in FIG. 20, the melt 2007 is injected by the injection plunger 2012 to the second runner 2058. The melt 2007, as shown in FIG. 26, flows through the second runner 2058 and fills the second cavity 2056.

In this way, the melt 2007 is filled in the second cavity without passing through the pin gates 2054, balance runner 2055, etc. formed in the three-part mold structure die casting mold 2001. Therefore, the time required for filling can be shortened and the second die casting 2062 can be formed in a short time.

As explained above, the melt is cast into the second cavity 2056 to form the second die casting 2062 having the shape of the second front end panel. Further, parts of the second runner 2058 and the extension sleeve 2057 are formed with a second runner sleeve casting 2077 corresponding to their shapes.

Figure 21:
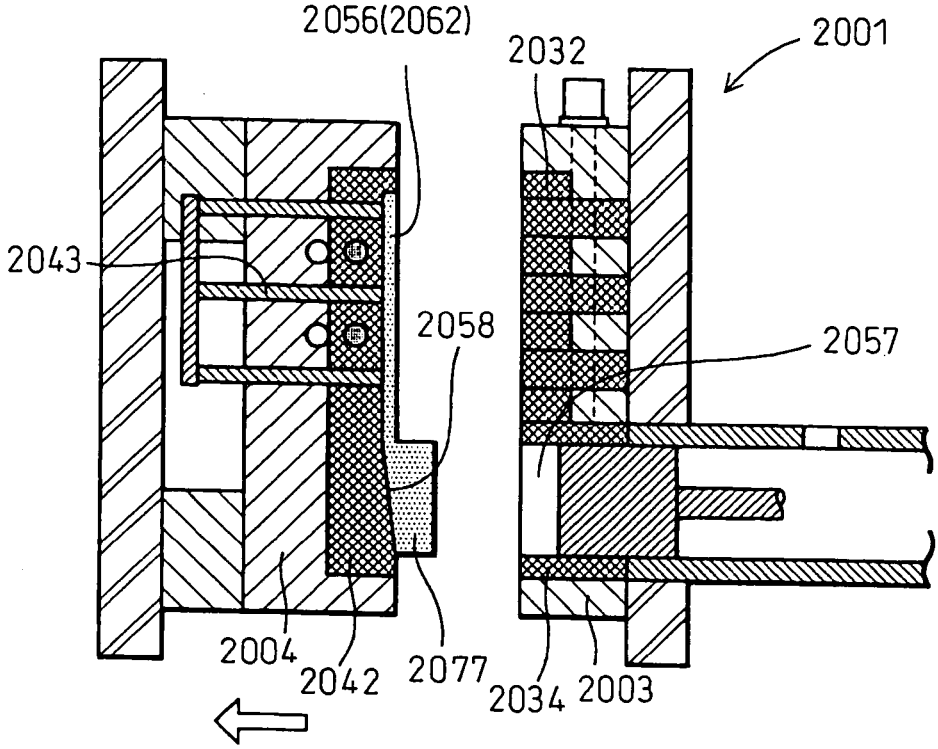
FIG. 21 is an explanatory view of a two-part mold structure die casting mold in a state with the movable mold moved with respect to the intermediate mold.
Figure 22:
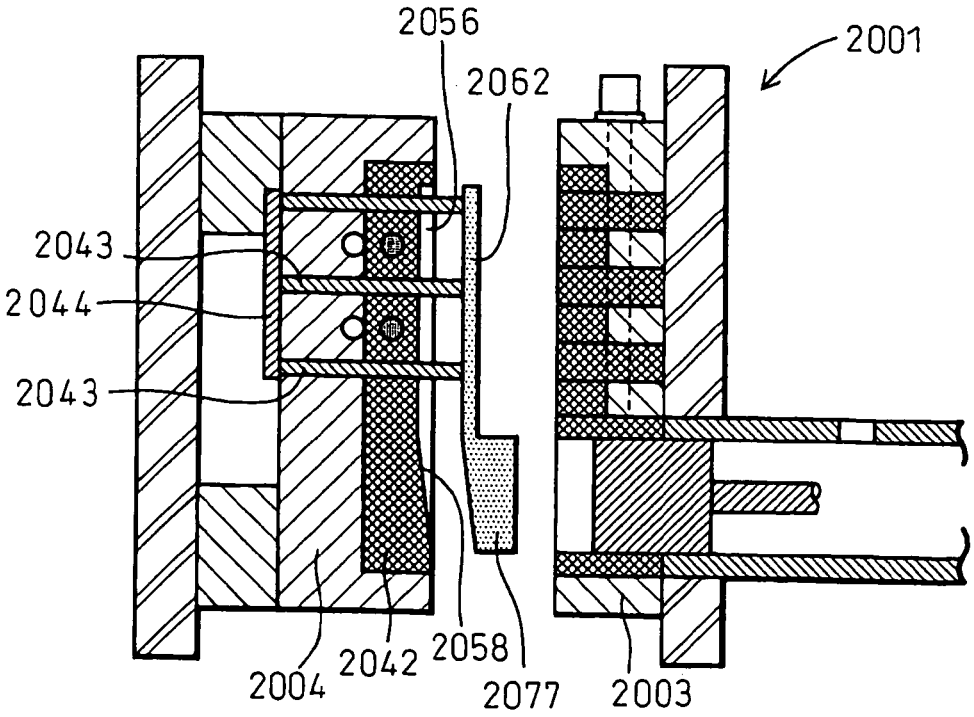
FIG. 22 is an explanatory view of a two-part mold structure die casting mold in a state with a second die casting ejected by ejector pins in the second embodiment.

Next, after forming the second die casting 2062, as shown in FIG. 21, the movable mold 2004 is moved relative to the intermediate mold 2003 to open the intermediate mold 2003 and movable mold 2004. Next, as shown in FIG. 22, the plurality of ejector pins 2043 provided at the ejector plates 2044 are simultaneously moved. Further, the second die casting 2062 with the second runner sleeve casting 2077 connected is released from the movable mold 2004. Next, as shown in FIG. 24, the second runner sleeve casting 2077 and other unnecessary parts are removed from the second die casting 2062 to obtain the final second die casting 2062.

In this way, in the two-part mold structure die casting mold 2001, it is possible to shorten the time for releasing the second die casting 2062 after formation from the second cavity 2056.

In this way, the fixed mold 2002 and intermediate mold 2003 used when forming the three-part mold structure may be used to form a two-part mold structure for forming a second die casting 2062 different from the first die casting 2061 formed when forming the three-part mold structure. Therefore, the same die casting mold 2001 may be used to form the die castings 2061 and 2062 of different shapes.

Further, as explained above, when forming the first die casting 2061 of the complicated shape having the island 2641 and connecting portion 2642, the above three-part mold structure die casting mold 2001 is formed. Due to this, it is possible to directly fill the melt through the opening pin gates 2542 into the difficult to cast opening cavity 2513. Therefore, at this time, it is possible to prevent casting defects and form a high quality first die casting 2061.

On the other hand, when forming a second die casting 2062 of not that complicated a shape not having the island 2641 and connecting portion 2642, the two-part mold structure die casting mold 2001 is formed. Due to this, it is possible to shorten the time required for casting, the time required for mold release, etc. to form the second die casting 2062 in a short time. Further, at the time of formation of the two-part mold structure, since the structure of the die casting mold 2001 is simple, it is possible to facilitate the handling and improve the maintenance property etc.

In this way, the die casting mold 2001 can combine the superior features of the above three-part mold structure and the superior features of the above two-part mold structure. That is, according to the die casting mold 2001, it is possible to suitably switch between the three-part mold structure and the two-part mold structure in accordance with the shape of the individual die castings 2061 and 2062 and cast the melt the best for the die castings 2061 and 2062.

In this example, the second runner 2058 is formed between the intermediate mold second insert 2032 and the movable mold second insert 2042.

Figure 27:
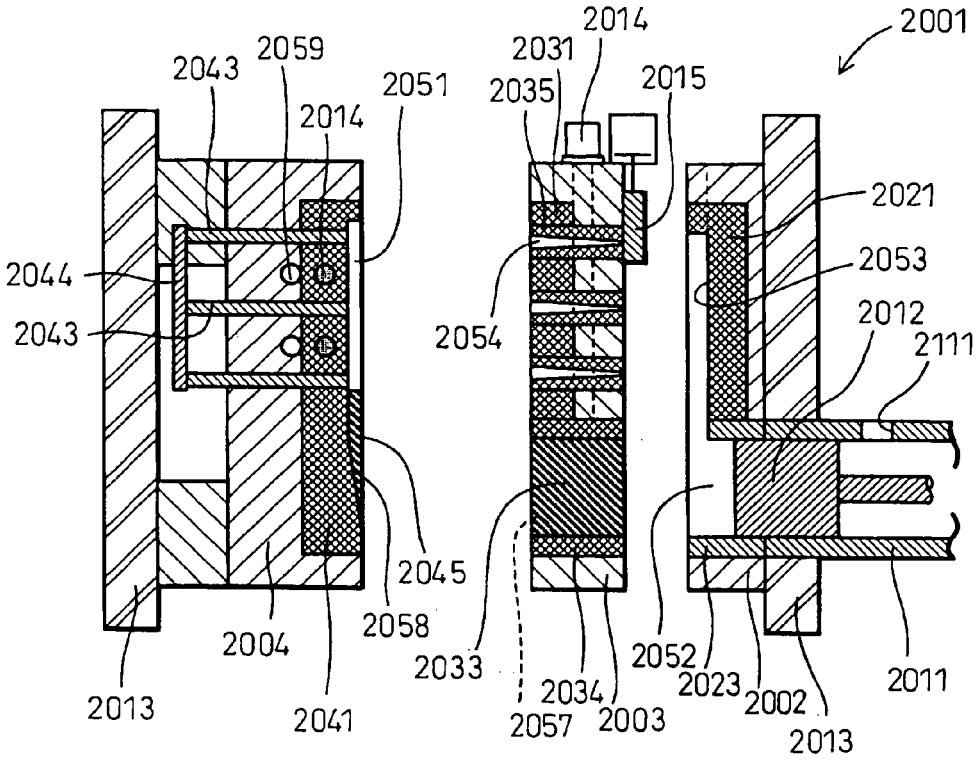
FIG. 27 is an explanatory view of another three-part mold structure die casting mold in the second embodiment.

As opposed to this, as shown in FIG. 27, the second runner 2058 is formed between the intermediate mold first insert 2031 and the above movable mold first insert 2041. When forming the three-part mold structure, the second runner 2058 may have a second runner insert 2045 inserted in it. Further, when forming the two-part mold structure, the second runner insert 2045 may be removed and the second runner 2058 formed. In this case as well, the method of changing the die casting mold 2001 from a three-part mold structure to a two-part mold structure is similar to that explained above.

Further, the three-part mold structure in the state with the second runner insert 2045 inserted in the second runner 2058 in this way may also be similarly employed for the following third and fourth embodiments.

Figure 28:
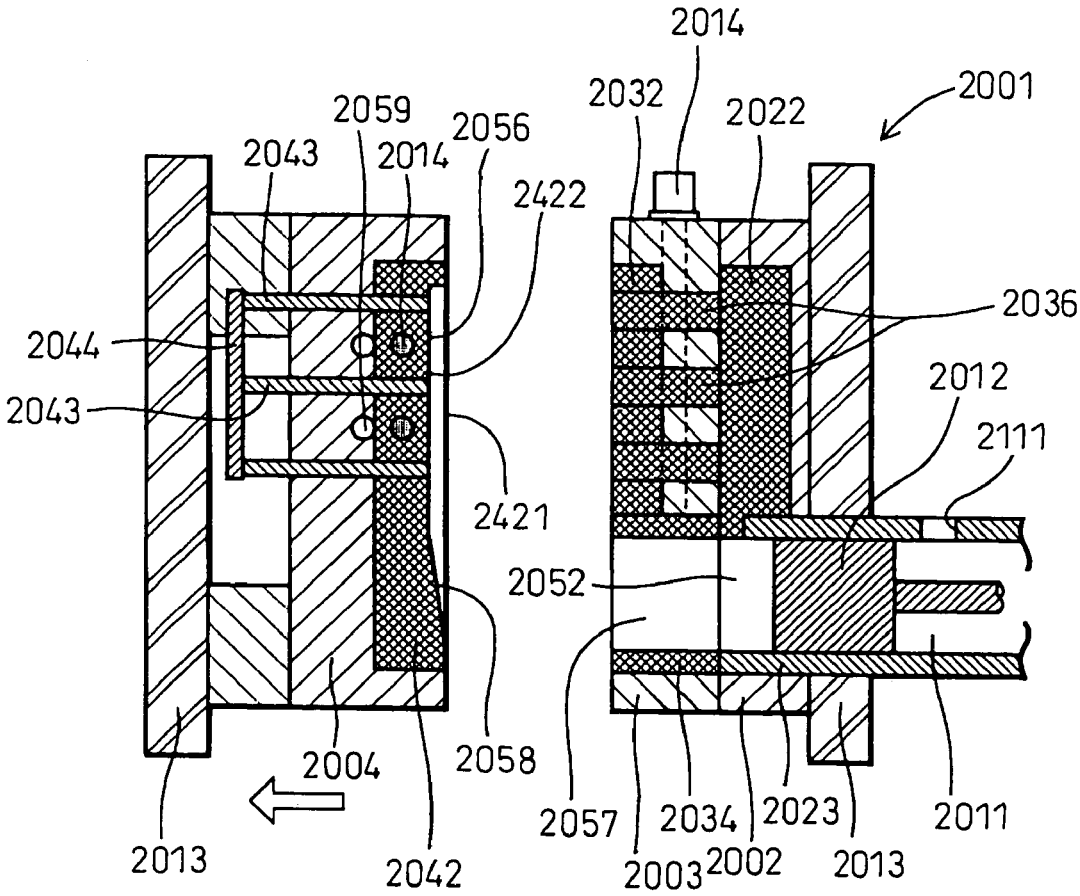
FIG. 28 is an explanatory view of a three-part mold structure die casting mold in a state in a third embodiment.

This embodiment, as shown in FIG. 28, uses the fixed mold 2002, intermediate mold 2003, and movable mold 2004 to form the two-part mold structure die casting mold 2001. In the two-part mold structure die casting mold 1001 of this embodiment, in the state with the fixed mold 2002 and the intermediate mold 2003 closed, that is, with the fixed mold 2002 and the intermediate mold 2003 fixed, the movable mold 2004 is moved with respect to these. Note that the configuration of the three-part mold structure die casting mold 2001 of this embodiment is similar to that of the second embodiment.

In this embodiment, when forming the two-part mold structure die casting mold 2001, the extension sleeve insert 2033 inserted in the extension sleeve 2057 at the intermediate mold 2003 is removed. Due to this, the extension sleeve 2057 connecting the connection sleeve 2052 to the intermediate mold 2003 is formed.

Further, in the same way as the second embodiment, the pin gate inserts 2035 forming the pin gates 2054 are removed from the intermediate mold 2003 and instead pin gate inserts 2036 not forming the pin gates 2054 are inserted in the intermediate mold 2003. Due to this, the pin gates 2054 are filled.

By replacing the fixed mold first insert 2021 forming the first runner 2053 with the fixed mold second insert 2022, the first runner 2053 is filled. Further, the intermediate mold first insert 2031 and the movable mold first insert 2041 are replaced with the intermediate mold second insert 2032 and movable mold second insert 2042. Further, the second runner 2058 of this embodiment is formed by a recess 2422 formed in the facing surface 2421 facing the intermediate mold 3 in the movable mold second insert 2042.

In this way, the two-part mold structure die casting mold 2001 forming the second cavity 2056 and connecting this and the extension sleeve 2057 by the second runner 2058 is formed. Further, it is possible to form a path of melt 2007 communicating from the connection sleeve 2052 to the second cavity 2056 through the extension sleeve 2057 and second runner 2058 and possible to form a two-part mold structure die casting mold 2001 moving the movable mold 2004 with respect to the fixed mold 2002 and intermediate mold 2003.

In this embodiment, when forming the two-part mold structure die casting mold 2001, the fixed mold 2002, intermediate mold 2003, and movable mold 2004 are used in the same way as the three-part mold structure die casting mold 2001, it is easy to change from the three-part mold structure to the two-part mold structure.

In addition, in this embodiment, the method of forming the die castings 2061 and 2062 when forming the three-part mold structure and two-part mold structure is similar to that of the second embodiment. The action and effects obtained are similar to those of the second embodiment.

Figure 29:
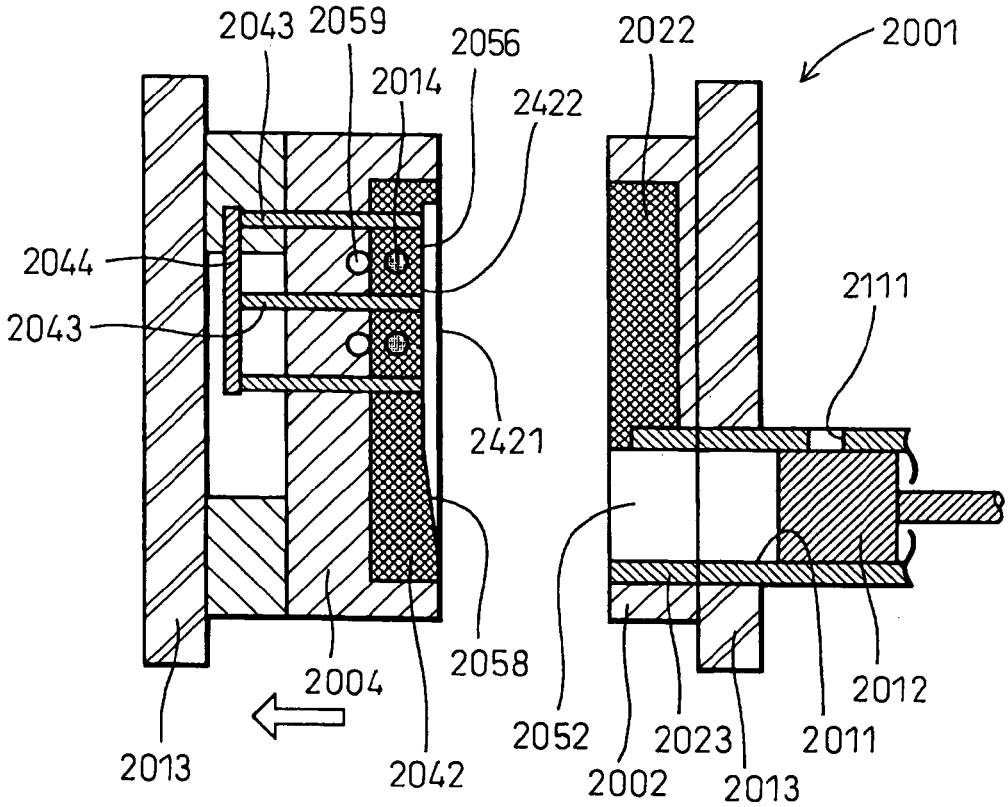
FIG. 29 is an explanatory view of a three-part mold structure die casting mold in a state in a fourth embodiment.

In this embodiment, as shown in FIG. 29, when forming the two-part mold structure die casting mold 2001, the intermediate mold 2003 is removed and the fixed mold 2002 and the movable mold 2004 are used. Further, in the two-part mold structure die casting mold 2001 of this embodiment, the movable mold 2004 is moved with respect to the fixed mold 2002.

Further, while not illustrated, in the three-part mold structure die casting mold 2001, the intermediate mold 2003 is not formed with the extension sleeve 2057 and does not have the extension sleeve insert 2033. The rest of the configuration of the three-part mold structure die casting mold 2001 is similar to that of the second embodiment.

Here, when forming the two-part mold structure die casting mold 2001, the intermediate mold 2003 is removed from the die casting mold 2001.

The movable mold first insert 2041 is replaced with the movable mold second insert 2042 forming part of the second cavity 2056 and the fixed mold first insert 2021 forming the first runner 2053 is replaced with the fixed mold second insert 2022 forming the remainder of the second cavity 2056.

Further, the second runner 2058 is formed by a recess 2422 formed in the facing surface 2421 facing the intermediate mold 2003 in the movable mold second insert 2042.

In this way, the two-part mold structure die casting mold 2001 forming the second cavity 2056 and connecting this and the connection sleeve 2052 by the second runner 2058 is formed. Further, it is possible to form a path of the melt 2007 communicating from the connection sleeve 2052 to the second cavity 2056 through the second runner 2058 and possible to form the two-part mold structure die casting mold 2001 moving the movable mold 2004 with respect to the fixed mold 2002.

In the three-part mold structure die casting mold 2001, the intermediate mold 2003 is not formed with the extension sleeve 2057 and the extension sleeve insert 2033 is not necessary. Therefore, according to the present invention, it is possible to form a two-part mold structure die casting mold 2001 extremely easily.

In addition, the method of formation of the individual die castings 2061 and 2062 when forming the three-part mold structure and the two-part mold structure is similar to that of the second embodiment. The actions and effects obtained are also similar to those of the second embodiment.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2001-203913, filed on Jul. 4, 2001, the disclosure of which is expressly incorporated herein by reference in its entirety.

The invention claimed is:

1. A casting method for casting a product having a body, an opening provided so as to pass through the body, an island provided separated from the body in the opening, and a connecting portion joining the island and body using a mold having a cavity corresponding to the shape of the product, the mold being provided with a body gate connected to a body cavity for forming the body in the cavity and a separate opening gate connected to an island/connecting portion cavity for forming the island and connecting portion in the opening in the cavity;

the body gate and opening gate being connected to a runner for introducing a melt into them; and the melt fed into the runner being filled in the cavity through the body gate and the opening gate; wherein the sectional area of the connecting portion being smaller than that of the body and a channel area of the island/connecting portion cavity being smaller than that of the body cavity.

2. A casting method as set forth in the claim 1, wherein, the mold has a three-part structure of a fixed mold, an intermediate mold, and a movable mold;

the fixed mold and the intermediate mold are provided between them with said runner;

the intermediate mold and movable mold are provided between them with said cavity, said body gate, and said opening gate;

the intermediate mold is provided with a body pin gate connecting the runner and the body gate and an opening pin gate connecting the runner and the opening gate; and the melt sent into the runner is filled in the cavity through the body pin gate and body gate and through the opening pin gate and opening gate.

3. A casting method as set forth in claim 2, comprising:

filling the melt, then moving said intermediate mold and movable mold to separate said fixed mold and said intermediate mold;

moving said movable mold to separate said intermediate mold and movable mold, cutting a runner casting formed in said runner from pin gate castings formed in said body pin gate and said opening pin gate, and releasing said pin gate castings from said intermediate mold;

then releasing the casting from said movable mold in the state with the pin gate castings attached.

4. A casting method as set forth in claim 2, wherein said intermediate mold and said movable mold have between them a balance runner provided at least at part of the section between said body pin gate and said body gate and at least at part of the section between said opening pin gate and said opening gate and wherein at least part of said melt is supplied from said body pin gate through said balance runner to said body gate and from said opening pin gate through said balance runner to said opening gate.

5. A casting method as set forth in claim 1, wherein said product is a front end panel for an automobile and has a body having a surround, an opening formed inside said surround, a part mount as an island arranged in said opening, and stays supporting said part mount as said connection portion.

6. A casting method as set forth in claim 5, wherein said part mount mounts a motor, fan, or pulley.

7. A casting mold for casting a product having a body, an opening provided so as to pass through the body, an island provided separated from the body in the opening, and a connecting portion joining the island and body, the mold having a three-part structure of fixed mold, an intermediate mold, and a movable mold;

the intermediate mold and the movable mold being provided between them with a cavity having a body cavity for forming the body and an island/connecting portion cavity for forming the island and the connecting portion in the opening, a body gate connected to the body cavity, and a separate opening gate connected to the island/connecting portion cavity;

the fixed mold and the intermediate mold being provided between them with a runner for introducing melt into the body gate and the opening gate;

the intermediate mold being provided with a body pin gate connecting the runner and the body gate and an opening pin gate connecting the runner and the opening gate; and the mold sent into the runner being filled in the cavity through the body pin gate and body gate and through the opening pin gate and opening gate; wherein the sectional area of the connecting portion being smaller than that of the body and a channel area of the island/connecting portion cavity being smaller than that of the body cavity.

8. A casting mold as set forth in claim 7, wherein a plurality of at least one of said body gate and said opening gate are provided.

9. A casting mold as set forth in claim 7, wherein said body pin gate and/or said opening pin gate is reversely tapered to expand in channel area from said fixed mold toward said movable mold or from said movable mold toward said fixed mold.

10. A casting mold as set forth in claim 7, wherein said body pin gate and/or said opening pin gate is provided at a cavity insert detachably inserted in a cavity insert setting hole provided in said intermediate mold.

11. A casting mold as set forth in claim 7, wherein a draft of a least part of an inner wall of said cavity at said movable mold side is not more than 1°.

12. A casting mold as set forth in claim 7, wherein said movable mold is provided with a plurality of ejector pins for pushing out the casting formed in the cavity from said cavity.

13. A casting mold as set forth in claim 12, wherein said ejector pins are provided to abut against said casting near body pin gates and/or opening pin gates.

14. A casting mold as set forth in claim 7, wherein said intermediate mold and said movable mold have between them a balance runner provided at least at part of the section between said body pin gate and said body gate and at least at part of the section between said opening pin gate and said opening gate.

15. A casting mold as set forth in claim 14, wherein said movable mold is provided with a plurality of ejector pins for pushing out the casting formed in the cavity from said cavity and wherein said ejector pins are provided to abut against said balance runner near the positions of body pin gates connected to said balance runner.

16. A casting mold as set forth in claim 15, wherein a projection projecting out in the direction of the intermediate mold is provided near a joining portion of said body pin gate and/or opening pin gate and said balance runner.

17. A casting mold as set forth in claim 7, wherein an end part formed at said movable mold in said body pin gate and/or said opening pin gate is provided with a distributor projecting out toward an inlet of said body pin gate and/or said opening pin gate.

18. A casting mold as set forth in claim 17, wherein said distributor is shaped with a draft of at least part of not more than 1°.

19. A casting mold as set forth in claim 7, wherein a portion where said body pin gate and/or said opening pin gate connects with said runner and is provided with a constricted part reduced in channel area.

20. A casting mold as set forth in claim 7, wherein said runner is branched into a body runner for introducing said melt into said body pin gate and an opening runner for introducing said melt into said opening pin gate.

21. A casting old as set forth in claim 20, wherein said body runner and said opening runner are adjusted in inside diameter so that the rates of filling said melt in them become substantially equal.

22. A casting mold as set forth in claim 20, wherein said opening runner has a shape similar to the shape of said island.

23. A casting mold as set forth in claim 7, wherein said cavity is connected to a pressure reducing means for reducing the pressure in said cavity.

24. A casting mold as set forth in claim 7, wherein said product is a front end panel for an automobile and has a body having a surround, an opening formed inside said surround, a part mount as an island arranged in said opening, and stays supporting said part mount as said connecting portion.

25. A casting mold as set forth in claim 24, wherein said part mount mounts a motor, fan, or pulley.

26. A casting method for casting a product having a body, an opening provided so as to pass through the body, an island provided separated from the body in the opening, and a connecting portion joining the island and body using a mold having a cavity corresponding to the shape of the product, the mold having a body cavity for forming the body in the cavity, an island/connecting portion cavity for forming the island and the connecting portion in the opening in the cavity, and a separate opening gate connected to the island/connecting portion cavity, the opening gate being connected to a runner introducing melt into it;

the mold fed into the runner being filled in the cavity through the opening gate; wherein the sectional area of the connecting portion being smaller than that of the body and a channel area of the island/connecting portion cavity being smaller than that of the body cavity.

27. A casting mold for casting a product having a body, an opening provided so as to pass through the body, an island provided separated from the body in the opening, and a connecting portion joining the island and body, the mold having a three-part structure of a fixed mold, intermediate mold, and movable mold;

the intermediate mold and movable mold being provided between them with a cavity having a body cavity for forming the body and an island/connecting portion cavity for forming the island and the connecting portion in the opening and a separate opening cavity connected to the island/connecting portion cavity;

the fixed mold and the intermediate mold being provided between them with a runner for introducing melt into the opening gate;

the intermediate mold being provided with an opening pin gate connecting the runner and the opening gate; and the melt sent into the runner being filled in the cavity through the opening pin gate and opening gate; wherein the sectional area of the connecting portion being smaller than that of the body and a channel area of the island/connecting portion cavity being smaller than that of the body cavity.

28. A three-part mold structure die casting mold having a fixed mold having a connection sleeve connected to an ejection sleeve for injecting a melt, an intermediate mold able to move with respect to said fixed mold, and a movable mold able to move with respect to said intermediate mold, said intermediate mold and said movable mold having between them a cavity for injection of said melt to form a die casting, said fixed mold and said intermediate mold having between them a first runner connected to said connection sleeve, and said intermediate mold having inside it a pin gate connecting said first runner and said cavity, wherein, said intermediate mold is formed with an extension sleeve provided on an extension of said connection sleeve, said intermediate mold and said movable mold have formed between them a second runner for connecting said extension sleeve and said cavity, said extension sleeve has an extension sleeve insert inserted in it for filling the same, and said second runner has a second runner insert inserted in it for filling the same;

said cavity is formed between an intermediate mold insert inserted detachably in said intermediate mold and a movable mold insert inserted detachably in said movable mold; and said die casting mold being adapted to form a two-part mold structure die casting mold moving said movable mold with respect to said intermediate mold by removing said fixed mold, removing said extension sleeve insert and said second runner insert inserted in said extension sleeve and said second runner, or filling said pin gate by a pin gate insert inserted into said intermediate mold and replacing at least one of said intermediate mold insert and said movable mold insert with another intermediate mold insert or another movable mold insert to form another cavity.

29. A die casting mold as set forth in claim 1, wherein:

said intermediate mold is formed with an extension sleeve provided on an extension of said connection sleeve, and said extension sleeve has an extension sleeve insert inserted in it for filling it;

said cavity is formed between an intermediate mold insert inserted detachably in said intermediate mold and a movable mold insert inserted detachably in said movable mold; and said die casting mold is designed to be able to form a two-part mold structure die casting mold moving said movable mold with respect to said intermediate mold by removing said fixed mold, removing said extension sleeve insert inserted in said extension sleeve, filling said pin gate by a pin gate insert to be inserted into said intermediate mold, and replacing at least one of said intermediate mold insert and said movable mold insert with another intermediate mold insert or another movable mold insert to form another cavity and a second runner connecting this and the above extension sleeve.

30. A die casting mold as set forth in claim 1, wherein:

said intermediate mold is formed with an extension sleeve provided on an extension of said connection sleeve, said intermediate mold and said movable mold have formed between them a second runner for connecting said extension sleeve and said cavity, said extension sleeve has an extension sleeve insert inserted in it for filling it, and said second runner has a second runner insert inserted in it for filling it;

said cavity is formed between an intermediate mold insert inserted detachably in said intermediate mold and a movable mold insert inserted detachably in said movable mold; and said die casting mold is designed to be able to form a two-part mold structure die casting mold moving said movable mold with respect to both said fixed mold and said intermediate mold in a state with the two closed by removing said extension sleeve insert and said second runner insert inserted in said extension sleeve and said second runner, filling said first runner by a fixed mold insert to be inserted in said fixed mold, filling said pin gate by a pin gate insert to be inserted into said intermediate mold, and replacing at least one of said intermediate mold insert and said movable mold insert with another intermediate mold insert or another movable mold insert to form another cavity.

31. A die casting mold as set forth in claim 1, wherein:

said intermediate mold is formed with an extension sleeve provided on an extension of said connection sleeve, and said extension sleeve has an extension sleeve insert inserted in it for filling it;

said cavity is formed between an intermediate mold insert inserted detachably in said intermediate mold and a movable mold inset inserted detachably in said movable mold; and said die casting mold is designed to be able to form a two-part mold structure die casting mold moving said movable mold with respect to both said fixed mold and said intermediate mold in a state with the two closed by removing said extensions sleeve insert inserted in said extension sleeve, filing said first runner by a fixed mold insert to be inserted in said fixed mold, filing said pin gate by a pin gate insert to be inserted into said intermediate mold, and replacing at least one of said intermediate mold insert and said movable mold insert with another intermediate mold inset to another movable mold insert to form another cavity and a second runner connecting this and the above extension sleeve.

32. A die casting mold as set forth in claim 1, wherein:

said intermediate mold and said movable mold have formed between them a second runner for connecting said connection sleeve and said cavity, and said second runner has a second runner insert inserted in it to fill it;

said cavity is formed between an intermediate mold insert inserted detachably in said intermediate mold and a movable mold insert inserted detachably in said movable mold, and said first runner is formed between a fixed mold insert inserted detachably with respect to said fixed mold and said intermediate mold; and said die casting mold is designed to be able to form a two-part mold structure die casting mold moving said movable mold with respect to said fixed mold by removing said intermediate mold, removing said second runner insert inserted in said second runner, and replacing said fixed mold insert with another fixed mold insert or replacing said fixed mold insert and said movable mold insert with other fixed mold insert and movable mold insert.

33. A die casting mold as set forth in claim 1, wherein:

said cavity is formed between an intermediate mold insert inserted detachably in said intermediate mold and a movable mold insert inserted detachably in said movable mold, and said first runner is formed between a fixed mold insert inserted detachably in said fixed mold and said intermediate mold; and said die casting mold is designed to be able to form a two-part mold structure die casting mold moving said movable mold with respect to said fixed mold by removing said intermediate mold and replacing said fixed mold insert with another fixed mold insert or replacing said fixed mold insert and said movable mold insert with another fixed mold insert and another movable mold insert to fill said first runner and form another cavity and a second runner connecting this and said extension sleeve.

34. A die casting mold as set forth in claim 28, wherein said movable mold is provided with a plurality of ejector pins for ejecting a die casting formed in said cavity from said cavity and a usage pin changing means for changing ejector pins used among said plurality of ejector pins between when forming said three-part mold structure and said two-part mold structure.

35. A die casting mold as set forth in claim 28, wherein said die casting mold has a burner unit for adjusting a surface temperature in said cavity around said cavity.

36. A die casting mold as set forth in claim 28, wherein said cavity is formed around it with a plurality of insertion and positioning holes enabling insertion and positioning of said burner unit, and said burner unit can be changed in arrangement among said insertion and positioning holes.

37. A die casting mold as set forth in claim 28, wherein said die casting mold is provided with a pressurizing cylinder for pressurizing said casting to cut it from a casting formed in said pin gate when separating a casting formed in said first runner from said intermediate mold in the case of forming said three-part mold structure.

38. A die casting mold as set forth in claim 28, wherein a die casting formed in said cavity is a front end panel for attaching an auto part at the front of an automobile and for supporting an engine.

39. A die casting mold as set forth in claim 1, wherein said movable mold is provided with a plurality of ejector pins for ejecting a die casting formed in said cavity from said cavity and a usage pin changing means for changing ejector pins used among said plurality of ejector pins between when forming said three-part mold structure and said two-part mold structure.

40. A die casting mold as set forth in claim 1, wherein said die casting mold has a burner unit for adjusting a surface temperature in said cavity around said cavity.

41. A die casting mold as set forth in claim 1, wherein said cavity is formed around it with a plurality of insertion and positioning holes enabling insertion and positioning of said burner unit, and said burner unit can be changed in arrangement among said insertion and positioning holes.

42. A die casting mold as set forth in claim 1, wherein said die casting mold is provided with a pressurizing cylinder for pressurizing said casting to cut it from a casting formed in said pin gate when separating a casting formed in said first runner from said intermediate mold in the case of forming said three-part mold structure.

43. A die casting mold as set forth in claim 1, wherein a die casting formed in said cavity is a front end panel for attaching an auto part at the front of an automobile and for supporting an engine.

* * * * *